US008538310B2

(12) United States Patent
Matsuda et al.

(10) Patent No.: US 8,538,310 B2
(45) Date of Patent: Sep. 17, 2013

(54) IMAGE TRANSFER APPARATUS, IMAGE FIXING APPARATUS, AND REGISTRATION APPARATUS WHICH PREVENT A LOAD TORQUE VARIATION UPON ENTRY OR EXIT OF A SHEET INTO A NIPPING PORTION

(75) Inventors: Hiromichi Matsuda, Kanagawa (JP); Toshiyuki Andoh, Kanagawa (JP); Takashi Hashimoto, Kanagawa (JP); Takashi Hodoshima, Kanagawa (JP); Tatsuhiko Oikawa, Kanagawa (JP); Hidetaka Noguchi, Hyogo (JP); Seiji Hoshino, Kanagawa (JP); Makoto Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 893 days.

(21) Appl. No.: 12/222,348

(22) Filed: Aug. 7, 2008

(65) Prior Publication Data

US 2009/0060613 A1 Mar. 5, 2009

(30) Foreign Application Priority Data

Aug. 30, 2007 (JP) ..... 2007-223895

(51) Int. Cl.
*G03G 15/00* (2006.01)
*G03G 15/08* (2006.01)
*G03G 15/16* (2006.01)

(52) U.S. Cl.
USPC ..... 399/388; 399/110; 399/121; 399/122; 399/394; 399/400

(58) Field of Classification Search
USPC ..... 399/318, 388, 32, 33, 67, 68, 69, 399/122, 66, 121, 394, 400, 45, 110; 492/42; 271/148, 226, 229
See application file for complete search history.

(56) References Cited

U.S. PATENT DOCUMENTS 5,737,679 A * 4/1998 Uehara et al. ..... 399/329
6,253,046 B1 * 6/2001 Horrall et al. ..... 399/124

(Continued)

FOREIGN PATENT DOCUMENTS

JP 61-090167 5/1986
JP 06-274051 9/1994

(Continued)

OTHER PUBLICATIONS

Abstract of JP 04-355782 published Dec. 9, 1992.

(Continued)

*Primary Examiner* — Judy Nguyen
*Assistant Examiner* — Blake A Tankersley
(74) *Attorney, Agent, or Firm* — Harness, Dickey & Pierce, P.L.C.

(57) ABSTRACT

A load torque variation upon entry or exit of a sheet into a nipping portion is reduced while a nipping force necessary for image formation is provided. An image transfer apparatus, an image fixing apparatus, or a registration apparatus comprises an opposite roller, a transfer roller, and a compression spring for pressing the opposite roller onto the transfer roller. A sheet of transfer material is transported into a nipping portion between the opposite roller and the transfer roller, where an image on the opposite roller is transferred to the transfer material. The apparatus includes a retaining unit configured to retain a certain distance between the first rotating body and the second rotating body as long as the thickness of the transfer material that passes through the nipping portion remains the same.

18 Claims, 14 Drawing Sheets

(56) References Cited

U.S. PATENT DOCUMENTS

| | | | | |
|---|---|---|---|---|
| 2004/0258427 | A1* | 12/2004 | Takahashi | 399/69 |
| 2007/0212085 | A1* | 9/2007 | Mitsuya et al. | 399/45 |

FOREIGN PATENT DOCUMENTS

| | | |
|---|---|---|
| JP | 10-076640 | 3/1998 |
| JP | 10-083124 | 3/1998 |
| JP | 2883916 | 2/1999 |
| JP | 11-084898 | 3/1999 |
| JP | 2000-190474 | 7/2000 |
| JP | 2003-029569 | 1/2003 |
| JP | 2006-317627 | 11/2006 |
| JP | 2007-010840 | 1/2007 |
| JP | 2008-040328 | 2/2008 |

OTHER PUBLICATIONS

Japanese Office Action dated Mar. 1, 2012 issued in Application No. 2007-223895.

* cited by examiner

IMAGE TRANSFER APPARATUS, IMAGE FIXING APPARATUS, AND REGISTRATION APPARATUS WHICH PREVENT A LOAD TORQUE VARIATION UPON ENTRY OR EXIT OF A SHEET INTO A NIPPING PORTION

BACKGROUND OF THE INVENTION

1. Field of the Invention

The present invention relates to image transfer apparatuses, image fixing apparatuses, and registration apparatuses in which a transfer material is transported into a nipping portion between a first rotating body rotated by a rotating force provided by a drive source and a second rotating body that is pressed against the first rotating body with a predetermined pressing force.

2. Description of the Related Art

In an electrophotographic image forming apparatus, a photosensitive material in the form of a drum or a belt is charged, and an electrostatic latent image is formed on the photosensitive drum or belt while it is rotated. The latent image is then visualized by causing toner to attach to it using a developing apparatus, whereby a toner image is formed on the image carrier, i.e., the drum or belt. The toner image is transferred onto the recording medium that is transported, such as a sheet of paper or an OHP film, either directly or via an intermediate transfer material that may be in the form of a belt.

In such an image forming apparatus, the transfer of the toner image on the image carrier onto the recording medium or the intermediate transfer material is carried out by an image transfer apparatus.

FIGS. 14A-14C show an image transfer apparatus in a conventional image forming apparatus, such as disclosed in Japanese Patent No. 2883916 or Japanese Laid-Open Patent Applications 61-90167.

With reference to FIG. 14A, the image transfer apparatus includes a displacement roller 201 disposed upstream of an image transfer position along a sheet transport path where an image is transferred by nipping a sheet. The displacement roller 201 is displaced downward as a sheet of transfer material 204 passes thereon, as shown in FIG. 14B, whereby the pressing force of a pressure roller 203, which is coupled to the displacement roller 201 via a connecting arm 202, is adjusted depending on the amount of movement of the displacement roller 201. In this way, the impact of the transfer material 204 as it enters the sheet-nipping image transfer position is reduced, as shown in FIG. 14C.

Japanese Laid-Open Patent Application No. 6-274051 discloses a mechanism in which a gap is produced at a nipping portion by moving a pressure roller with a drive force provided by a drive unit. Specifically, an arm that supports the pressure roller is pressed down by the rotating force of an elliptic cam in order to produce a gap at the nipping portion in advance. The gap is subsequently eliminated and the pressure roller is pressed onto a drum upon entry of a sheet into the nipping portion between the roller and the drum.

Japanese Laid-Open Patent Application No. 2006-317627 discloses that, in order to reduce a load torque variation that occurs in a secondary transfer unit in an image forming apparatus due to the entry or exit of a thick sheet, the inertia of a pressure roller in the secondary transfer unit is minimized.

In the aforementioned technologies disclosed in Japanese Patent No. 2883916 and Japanese Laid-Open Patent Applications 61-90167, the presence of the displacement roller and the connecting arm increases the size of the transfer apparatus. In addition, because the transfer pressure varies depending on the thickness of the sheet, it is difficult to obtain appropriate transfer/nipping conditions. Since the purpose of nipping a sheet in a transfer apparatus or a fixing apparatus is to give a desired pressure to the toner image, a constant pressure needs to be imparted regardless of the thickness of the sheet. However, in the apparatuses according to these publications, nipping conditions vary depending on the depressing force of the connecting arm, which varies depending on the thickness of the sheet. As a result, a defective transfer or fixing may easily occur when a thick sheet is used.

In the aforementioned technology according to Japanese Laid-Open Patent Application No. 6-274051, in order to allow the arm to be moved at high speed against a pressing force, the actuator including the arm needs to have high rigidity and be able to provide a high torque. In recent years, the sheet transport speeds have been increased for productivity improvement purposes. There is also a demand to increase the image area on a sheet (i.e., reduction of the margin, or "borderless" image). Thus, in accordance with this technology, it is necessary to perform an operation of switching from a spaced-apart condition to a nipped condition in the nipping portion instantaneously. For example, in an image forming apparatus in which a sheet is transported at the speed of 200 mm/s, if it is desired to transfer an image onto the sheet 2 mm from its front edge, it is necessary to switch from a spaced-apart state to a nipped state approximately 0.01 second after the entry of the sheet into the nipping portion. However, it is difficult to realize a drive control mechanism that produces a torque with which the switching can be performed at such high speed. Furthermore, the impact upon pressing one roller onto another tends to produce vibrations.

In the aforementioned technology according to Japanese Laid-Open Patent Application No. 2006-317627, the pressing roller is pressed against an opposite roller via an elastic member. The pressing roller is required to have sufficient rigidity so that a uniform pressure can be imparted along the axis of the roller. Thus, there is a limit to which the inertia of the roller can be reduced.

In a conventional apparatus utilizing a pressing force, such as the aforementioned transfer apparatuses, in an electrophotographic apparatus as an image forming apparatus, a transfer material, such as a sheet of paper, may be transported to a nipping portion between a fixed roller and a pressing roller that is pressed against the fixed roller in order to transfer an image formed on the fixed roller onto the transfer material. Alternatively, in such a transfer apparatus, a transfer material may be passed through a nipping portion between a belt transported on a roller and another roller, in order to transfer an image on the belt onto the transfer material. In such transfer apparatuses, there is the problem that a load torque variation occurs when the transfer material enters or exits the nipping portion, resulting in a speed variation in the transfer material.

In the aforementioned conventional art according to Japanese Laid-Open Patent Application No. 6-274051, in which the roller and the drum are spaced apart in advance, a mechanism is required to produce a gap greater than the thickness of the transfer material. Such a separating mechanism requires a drive apparatus capable of producing a large torque.

SUMMARY OF THE INVENTION

It is a general object of the present invention to provide a novel and useful image transfer apparatus, fixing apparatus, and registration apparatus in which the aforementioned problems are eliminated. A more specific object is to prevent a load torque variation upon entry or exit of a sheet into a nipping portion while providing a sufficient nipping force required for image formation.

In one aspect, the invention provides an image transfer apparatus comprising a first rotating body that is rotated by a rotating drive force provided by a drive source; a second rotating body disposed near the first rotating body; and a pressing unit configured to press the second rotating body onto the first rotating body with a predetermined pressing force. A sheet of a transfer material is transported into a nipping portion between the first rotating body and the second rotating body, and an image formed on the first rotating body or a belt transported on the first rotating body is transferred onto the transfer material. The apparatus further includes a retaining unit configured to maintain a distance between the first rotating body and the second rotating body as long as the thickness of the transfer material that passes through the nipping portion remains the same.

In a preferred embodiment, the retaining unit comprises a one-way clutch mechanism that regulates the movement of the second rotating body by the pressing unit in a pressing direction while allowing the second rotating body to move freely in a direction opposite the pressing direction. The second rotating body is allowed to move freely in the pressing direction by a predetermined distance.

In another preferred embodiment, the retaining unit retains an outer diameter portion of the second rotating body.

In another preferred embodiment, the image transfer apparatus further comprises an arm member having a rotation center. The retaining unit is disposed on the arm member.

In another preferred embodiment, each of the first rotating body and the second rotating body includes a driving force transmitting unit configured to transmit a drive force from the same or an individual drive source.

In another aspect, the invention provides an image fixing apparatus comprising a first rotating body that is rotated by a rotating drive force provided by a drive source, the first rotating body including a heating member or supporting a heating member in the form of an endless belt; a second rotating body disposed near the first rotating body; and a pressing unit configured to press the second rotating body onto the first rotating body with a predetermined pressing force in order to fix a visible image on a transfer material that is transported through a nipping portion between the first rotating body and the second rotating body. The apparatus further includes a retaining unit configured to maintain a distance between the first rotating body and the second rotating body as long as the thickness of the transfer material that passes through the nipping portion remains the same.

In a preferred embodiment, the retaining unit comprises a one-way clutch mechanism that regulates the movement of the second rotating body by the pressing unit in a pressing direction while allowing the second rotating body to move freely in a direction opposite the pressing direction. The second rotating body is allowed to move freely in the pressing direction by a predetermined distance.

In another preferred embodiment, the retaining unit retains an outer diameter portion of the second rotating body.

In another preferred embodiment, the image fixing apparatus comprises an arm member having a rotation center. The retaining unit is disposed on the arm member.

In another preferred embodiment, each of the first rotating body and the second rotating body includes a driving force transmitting unit configured to transmit a drive force from the same or an individual drive source.

In another aspect, the invention provides a registration apparatus comprising a first rotating body that is rotated by a rotating drive force provided by a drive source; a second rotating body disposed near the first rotating body; and a pressing unit configured to press the second rotating body onto the first rotating body with a predetermined pressing force. A sheet of a transfer material is transported into a nipping portion between the first rotating body and the second rotating body, and an image formed on the first rotating body or a belt transported on the first rotating body is transferred onto the transfer material. The registration apparatus further includes a retaining unit configured to maintain a distance between the first rotating body and the second rotating body as long as the thickness of the transfer material that passes through the nipping portion remains the same.

In a preferred embodiment, the retaining unit comprises a one-way clutch mechanism that regulates the movement of the second rotating body by the pressing unit in a pressing direction while allowing the second rotating body to move freely in a direction opposite the pressing direction. The second rotating body is allowed to move freely in the pressing direction by a predetermined distance.

In another preferred embodiment, the retaining unit retains an outer diameter portion of the second rotating body.

In another preferred embodiment, the registration apparatus further comprises an arm member having a rotation center. The retaining unit is disposed on the arm member.

In another preferred embodiment, each of the first rotating body and the second rotating body includes a driving force transmitting unit configured to transmit a drive force from the same or an individual drive source.

In accordance with an embodiment of the invention, the amount by which a pressure roller is depressed upon entry of a transfer material, and the amount by which the pressure roller is pushed up upon exit of the transfer material, can be greatly reduced. Thus, the load torque variation on the transfer material transport drive system can be reduced, whereby the transfer material transport speed variation due to the load torque variation can be reduced.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

Hereafter, embodiments of the present invention are described with reference to the drawings.

Based on a study conducted by the present inventors on the load torque variation that occurs when a transfer material enters a nipping portion between rollers, the following facts were observed:

(1) As the front end of the transfer material enters the nipping portion between the rollers, one of the rollers, i.e., the pressure roller, is moved against a pressing force, thereby increasing the load torque.

(2) As the rear end of the transfer material leaves the nipping portion between the rollers, the pressure roller as it is pressed by the pressing force pushes the transfer material in the transport direction, thereby reducing the load torque.

(3) Of the aforementioned load torque variations, a portion that exceeds an acceptable load torque range of the drive system as a whole, which is determined by a permitted torque of a drive source and the rigidity of the driving-force transmitting system including a series of gears for transmitting a drive force from the drive source to the rollers, causes a rotation variation in the rollers that affects an output image.

Conventionally, a method is proposed whereby a gap greater than the thickness of the transfer material is provided between the rollers, and the gap is eliminated to nip the transfer material upon its arrival between the rollers. However, there has been the problem of impact upon nipping the transfer material and also the need to provide a power source for forming the gap. The present inventors realized that actually it is not necessary to make the gap between the rollers greater than the thickness of the transfer material, and that the load torque can be controlled to stay within an acceptable load torque range even with a gap smaller than the transfer material thickness. Thus, an apparatus has been realized in which a sufficient roller center distance can be obtained without providing a drive mechanism for separating the two rollers apart.

In accordance with an embodiment of the present invention, a roller center distance is maintained so that the load torque produced by the vertical movement of a pressure roller upon entry or exit of the transfer material into or out of the nipping portion can be reduced regardless of the thickness of the transfer material. In this way, the load torque variation upon entry or exit of a sheet is prevented while a pressing force required for image formation is provided.

Figure 1:
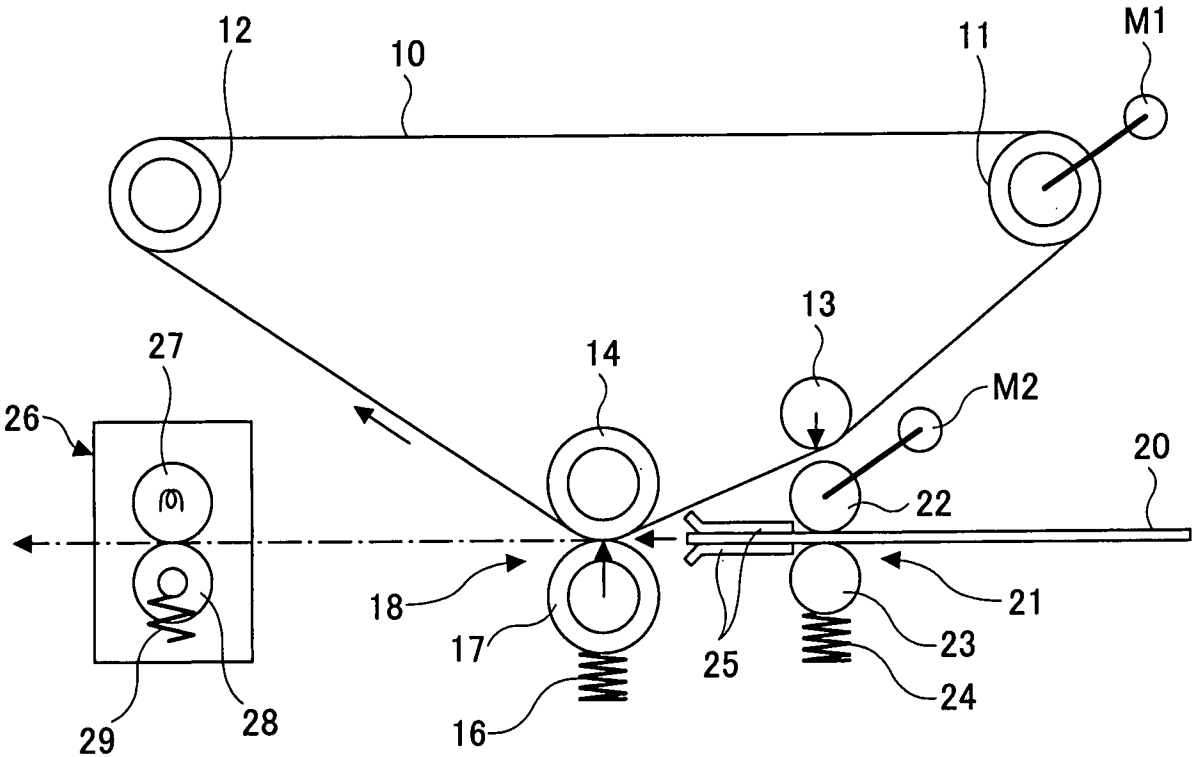
FIG. 1 schematically shows a photosensitive belt unit of an image forming apparatus.

In the following, the phenomenon of load torque variation in an image forming apparatus and its mechanism are discussed. FIG. 1 shows a photosensitive belt unit in the image forming apparatus.

In this photosensitive belt unit, a photosensitive belt 10 is extended on a drive roller 11, a driven roller 12, a tension roller 13, and an opposite roller 14. The photosensitive belt 10 is transported in the clockwise direction as the drive roller 11 is driven by a drive motor M1. Against the opposite roller 14, a transfer roller 17 is pressed via the photosensitive belt 10 by being biased by a compression spring 16, which is a biasing mechanism, thereby forming a nipping portion in a transfer apparatus 18.

Between the photosensitive belt 10 and the transfer roller 17, a transfer material transport path is formed along which a transfer material 20 is transported through the nipping portion from right to left in the drawing. Upstream of the transfer material transport path, there is provided a pair of register rollers 22 and 23, forming a registration apparatus 21. As one of the register rollers, 22, is driven by a drive motor M2, the other register roller, 23, which is biased toward the register roller 22 by a compression spring 24 as a biasing mechanism, is driven, thereby transporting the transfer material 20. Downstream of the pair of register rollers 22 and 23, there is disposed a pair of guide plates 25 that guide the transfer material 20 to the nipping portion of the transfer apparatus 18. Downstream of the nipping portion of the transfer apparatus 18, there is disposed a fixing apparatus 26. The fixing apparatus 26 is composed of a heating roller 27 having a heat source, and a pressure roller 28 biased by a compression spring 29 and pressed against the heating roller 27.

In this photosensitive belt unit, the transfer material 20, which is fed from a sheet feeder unit which is not shown, once abuts against the register rollers 22 and 23 where it stands by. As the drive roller 11 is driven by the drive motor M1, the photosensitive belt 10 runs and while it runs, an image is formed thereon by an image forming apparatus (not shown). At a time determined with reference to the front end of the image on the photosensitive belt 10, the register roller 22 is started by the drive motor M2, whereby the transfer material 20 is fed into the nipping portion of the transfer apparatus 18. A toner image carried on the photosensitive belt 10 is then transferred onto the transfer material 20 by the pressing force of the compression spring 16 and a transfer bias applied to the transfer roller 17. Thereafter, heat and pressure are applied to the transfer material 20 by the heating roller 27 and the pressure roller 28 in the fixing apparatus 26, whereby the toner image is fixed on the transfer material 20.

Figure 2:
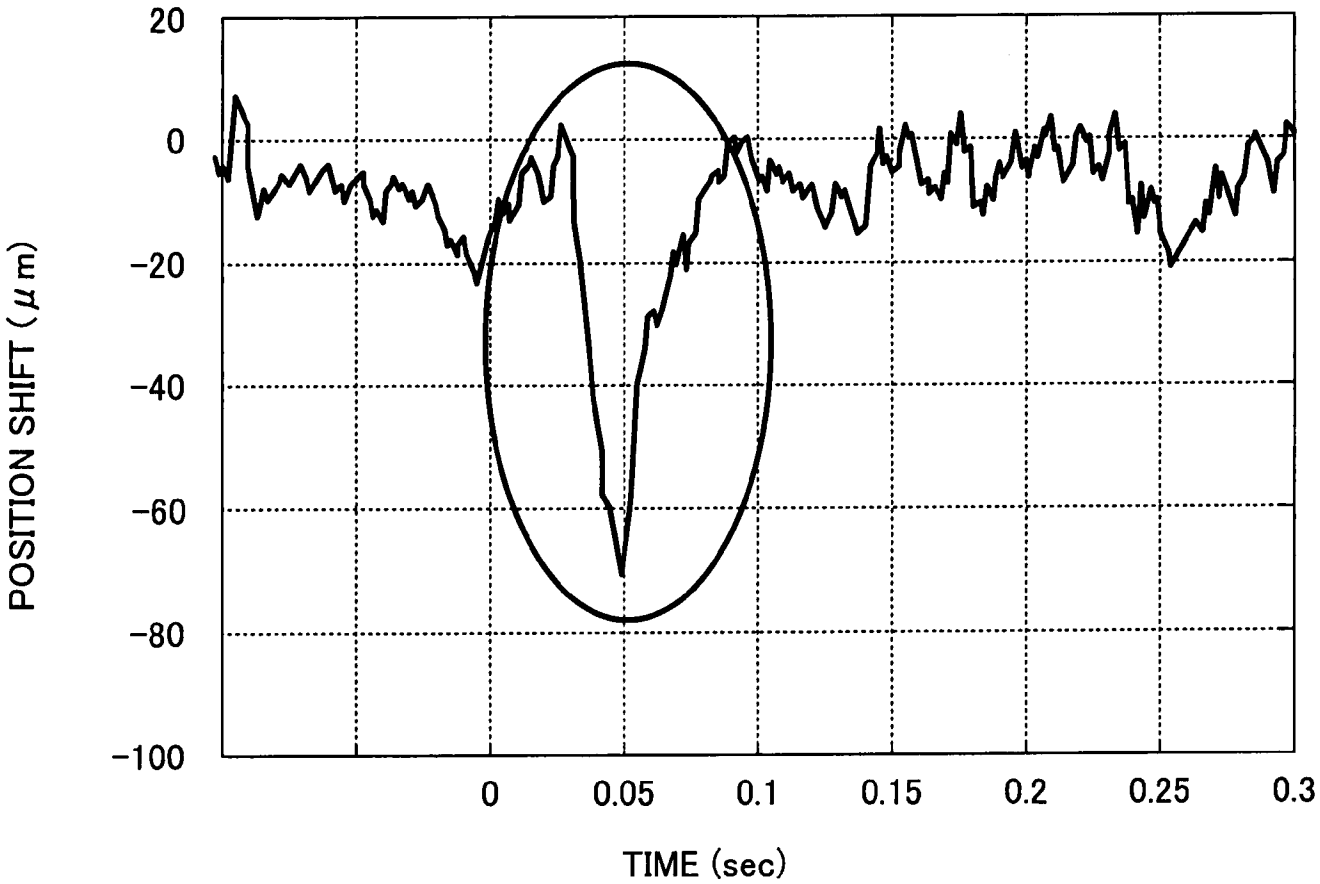
FIG. 2 shows a graph indicating a transport position error of a photosensitive belt when a transfer material passes between an opposite roller and a transfer roller pressed against the opposite roller in a transfer apparatus.

The phenomenon of load torque variation in the photosensitive belt unit is described. FIG. 2 shows a graph indicating a transport position error of the photosensitive belt 10 when the transfer material 20 passes between the opposite roller 14 and the transfer roller 17 pressed against the opposite roller 14 in the transfer apparatus 18. The horizontal axis shows time; the transfer material 20 enters the nipping portion between the rollers 14 and 17 at time 0. The vertical axis shows the position variation, indicating the error or shift of the photosensitive belt transport distance with respect to a desired transport distance (position). As indicated by the oval in the graph, it is seen that the position error of the photosensitive belt 10 shifts in the negative direction upon entry of the transfer material 20 into the nipping portion. This means that the transport of the photosensitive belt 10 is delayed by the load torque variation due to the entry of the transfer material 20. Such a position variation greatly affects the image being formed on the photosensitive belt 10.

A similar phenomenon also occurs in the fixing apparatus 26. Namely, upon entry of the transfer material 20 into the nipping portion in the fixing apparatus 26, the rotation speed of the heating roller 27 drops due to the load torque variation (i.e., sudden increase in load torque). Simultaneously, the amount of transport of the transfer material 20 in the nipping portion in the fixing apparatus 26 also decreases. In the image forming apparatus, the fixing apparatus 26 is provided immediately after the transfer apparatus 18. Upon entry of the transfer material 20 into the fixing apparatus 26, the transfer material 20 is nipped by both the fixing apparatus 26 and the transfer apparatus 18. Thus, the decrease in the amount of transport of the transfer material 20 greatly affects the image being transferred by the transfer apparatus 18.

A similar phenomenon also occurs in the registration apparatus 21. Specifically, a load torque variation occurs such that the load torque sharply drops as the transfer material 20 exits a nipping portion between the register rollers 22 and 23. As a result, the rotation speed of the register rollers 22 and 23 increases, and so does the transport speed of the transfer material 20. When the transfer material 20 is nipped by both the transfer apparatus 18 and the registration apparatus 21, the image transferred onto the transfer apparatus 18 is greatly affected.

A transfer material transport apparatus according to an embodiment of the invention as described below includes a first rotating body, such as the opposite roller 14, the register roller 22, or the heating roller 27; a second rotating body that is movable into and out of contact with the first rotating body, such as the transfer roller 17, the register roller 23, or the pressure roller 28; and a biasing unit configured to bias the second rotating body onto the first rotating body, such as the compression spring 16, 24, or 29. The transport apparatus may be used in any of the transfer apparatus 18, the registration apparatus 21, and the fixing apparatus 26 in which the transfer material 20 is transported between the first rotating body and the second rotating body.

Hereafter, the mechanism of the development of the load torque variation is described. An analysis conducted by the present inventors revealed that the drop in the speed of the photosensitive belt 10 upon entry of the transfer material 20 is mainly due to the increase in load torque that is caused as the transfer roller 17 is moved downward by the transfer material 20 as it enters the nipping portion formed by the transfer roller 17 and the opposite roller 14. On the other hand, when the transfer material 20 exits the nipping portion, the speed of the photosensitive belt 10 increases. This is mainly due to the decrease in the load torque caused by the transfer material 20 leaving the nipping portion, which results in the transfer roller 17 moving upward due to the pressing force applied to it, thereby pushing the transfer material 20 in the transport direction. The details are described below.

Figure 3:
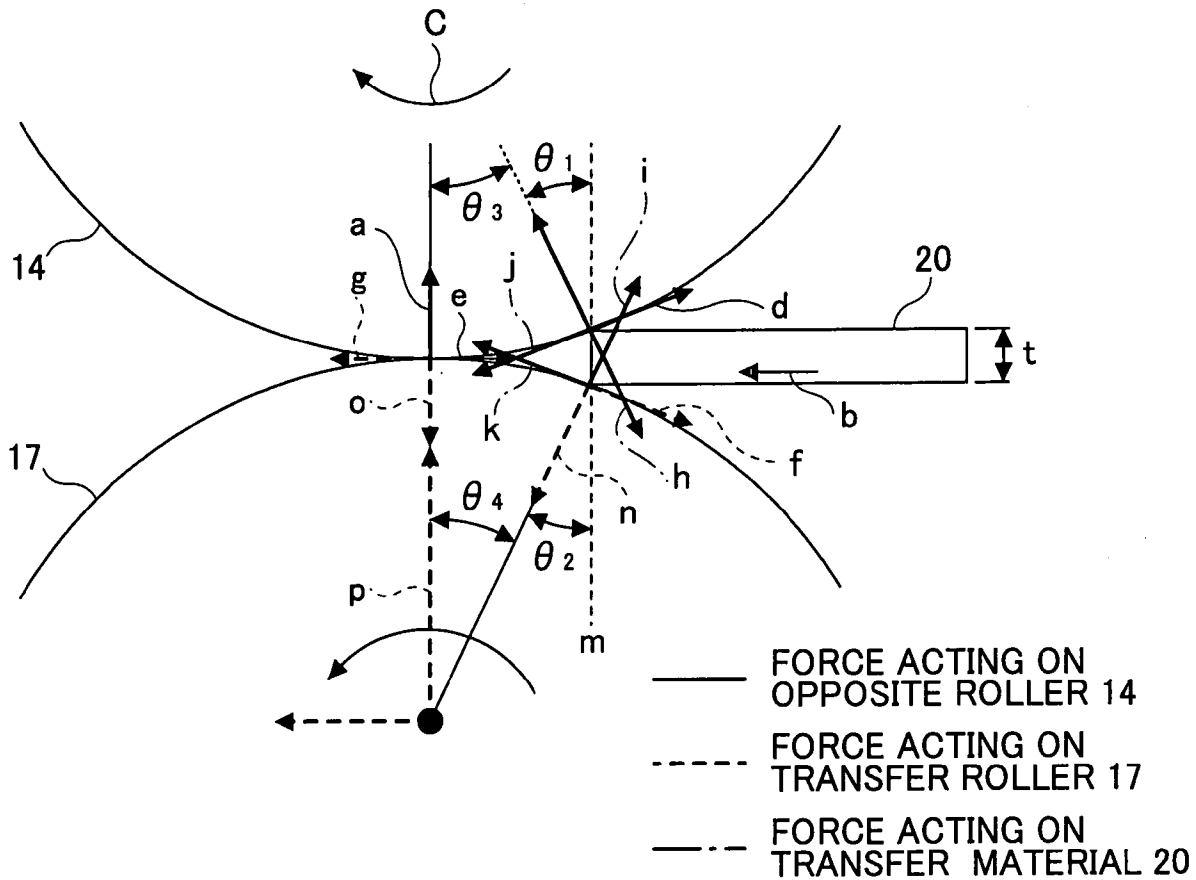
FIG. 3 shows a diagrammatic illustration of a mechanism of the development of a torque load variation in the transfer apparatus.

Hereafter, a description is given of the mechanism of the development of the torque load variation upon entry of the transfer material 20 in the transfer apparatus 18 as a transfer material transport apparatus. FIG. 3 is a diagrammatic illustration of the mechanism of the development of the torque load variation in the transfer apparatus 18. The diagram depicts mechanical relationships among various forces upon entry of the transfer material 20 into the nipping portion between the opposite roller 14, which is the first rotating body, and the transfer roller 17, which is the second rotating body. While in the foregoing description of the image forming apparatus there has been the photosensitive belt 10 between the opposite roller 14 and the transfer roller 17, the photosensitive belt 10 is omitted in FIG. 3 because its influence on the load torque variation is small. Its influence is small because the photosensitive belt 10, which is wound on the opposite roller 14 by the tension provided by the tension roller 13, slips little, and therefore the photosensitive belt 10 can be considered to move together with and be a part of the opposite roller 14 in a model. Namely, in the present model, the thickness of the photosensitive belt 10 is reflected in the diameter of the opposite roller 14.

Initially, the relationship between the nipping portion between the opposite roller 14 and the transfer roller 17 and the transfer material 20 is described. The opposite roller 14 is fixed both in the horizontal direction and vertical direction; it is movable only in the rotating direction.

In the apparatus shown, the rotating shaft of the opposite roller 14 is supported by a bearing which is not shown. The bearing may be fixed to a casing of the image forming apparatus, or a casing of the photosensitive belt transport unit. On the other hand, the transfer roller 17 is movable in the vertical direction and the rotating direction, without its rotating shaft fixed. With the rotating shaft of the transfer roller 17, the compression spring 16, which is a biasing mechanism, is in contact as shown in FIG. 1. Thus, a pressing force a acts in the direction of the opposite roller 14, whereby the transfer roller 17 is pressed against the opposite roller 14. The transfer material 20 has a thickness t and enters into the nipping portion horizontally. The transfer material 20 as it is being transported has a thrust b. In the figure, the transfer material 20 is transported in the horizontal direction and comes into contact not with either the opposite roller 14 or the transfer roller 17 first but with them both simultaneously in the nipping portion.

With reference to FIG. 3, the balance of forces upon contact of the transfer material 20 with the rollers 14 and 17 (in a static mechanical equilibrium state) is described. First, the balance of forces in the rotating direction of the opposite roller 14 is described. The opposite roller 14 has a rotating force (rotating torque) c in the clockwise direction. The rotating torque c is supplied by a drive source (motor), which is not shown. In practice, the opposite roller 14 rotates at a desired average speed, and produces a predetermined load torque. In the present example, the static model is employed excluding the predetermined load torque in order to describe the load torque variation upon entry of the transfer material 20 into the nipping portion. The balance of forces in the rotating direction of the opposite roller 14 is related to a load torque variation ΔT which is expressed by:

$$\Delta T = R_1(F_1 + F_3) \tag{1}$$

where:

$R_1$ is the radius of the opposite roller 14;

$F_1$ is a frictional force d at the contact portion of the opposite roller 14 and the transfer material 20 in the rotating direction; and $F_3$ is a frictional force e at the contact portion of the transfer roller 17 in the rotating direction.

The balance of forces in the rotating direction of the transfer roller 17, which is driven by the opposite roller 14, is expressed by:

$$R_2F_3' = R_2F_2 \tag{2}$$

where:

$R_2$ is the radius of the transfer roller 17;

$F_2$ is a frictional force f at the contact portion between the transfer roller 17 and the transfer material 20 in the rotating direction; and $F_3'$ is a frictional force g at the contact portion of the opposite roller 14 in the rotating direction.

The balance of forces of the transfer material 20 in the horizontal direction is described. Upon contact of the transfer material 20 with both the opposite roller 14 and the transfer roller 17, the balance of forces is expressed by:

$$N_1 \sin\theta_1 + N_2 \sin\theta_2 = F_1' \cos\theta_1 + F_2' \cos\theta_2 \quad (3)$$

where:

$N_1$ is a normal force h at the contact portion between the opposite roller 14 and the transfer material 20;

$N_2$ is a normal force i at the contact portion between the transfer roller 17 and the transfer material 20;

$F_1'$ is a frictional force j at the contact portion between the opposite roller 14 and the transfer material 20 in the rotating direction;

$F_2'$ is a frictional force k at the contact portion between the transfer roller 17 and the transfer material 20 in the rotating direction;

$\theta_1$ is an angle formed by a contact surface m of the transfer material and a line connecting the rotation center of the opposite roller 14 and a point of contact between the surface m and the opposite roller 14; and $\theta_2$ is an angle formed by the contact surface m of the transfer material and a line connecting the rotation center of the transfer roller 17 and a point of contact between the surface m and the transfer roller 17.

When the transfer material 20 enters the transfer nipping portion horizontally, the contact surface m is parallel to a line connecting the rotation centers of the both rollers. Therefore, angles $\theta_3$ and $\theta_1$ and angles $\theta_4$ and $\theta_2$ are the same.

Similarly, the balance of forces in the vertical direction of the transfer material 20 is expressed by:

$$N_1 \cos\theta_1 + F_1' \sin\theta_1 = N_2 \cos\theta_2 + F_2' \sin\theta_2 \quad (4)$$

The balance of forces with respect to the rotating shaft of the transfer roller 17 is described.

In the vertical direction, the following equation (5) is satisfied:

$$P = N_2' \cos\theta_2 + F_2 \sin\theta_2 + N_3 \quad (5)$$

where:

$N_2'$ is a normal force n at the contact portion between the transfer roller 17 and the transfer material 20;

$N_3$ is a normal force o at the contact portion between the opposite roller 14 and the transfer roller 17; and P is a pressing force p of the transfer roller 17.

A torque $\Delta T$ required for the transfer roller 17 to move away from the opposite roller 14 is determined. When the transfer roller 17 and the opposite roller 14 are spaced apart from each other, the following are satisfied:

$$N_3 = 0,\ F_3 = 0 \quad (6)$$

By modifying and substituting Equations (1) through (6), relationships between the torque $\Delta T$ and the pressing force or the fixing force of the transfer roller 17 are determined. The torque $\Delta T$ can be divided into a torque $\Delta T_v$ for the transfer roller 17 to move in the vertical direction, and a torque $\Delta T_h$ for it to move in the horizontal direction, as expressed by:

$$\Delta T_v = \frac{PR_1 \sin(\theta_1 + \theta_2)}{\cos\theta_2} \quad (7)$$

$$\Delta T_h = \frac{N_4 R_1 \sin(\theta_1 + \theta_2)}{\sin\theta_2} \quad (8)$$

where $N_4$ is a pressing force (fixing force) of the transfer roller 17 in the horizontal direction.

The sum of the vertical component (Equation (7)) and the horizontal component (Equation (8)) is the load torque variation $\Delta T$ required for the transfer material 20 to be transported through the transfer nipping portion while pressing down the transfer roller 17. When the load torque variation exceeds the torque (permitted torque) that can be supplied to the opposite roller 14 from the motor driving it, a rotation variation develops in the opposite roller 14, resulting in a linear velocity variation in the photosensitive belt 10 and causing image degradation.

While the phenomenon upon entry of the transfer material has been described above, a similar phenomenon also occurs upon exit of the transfer material 20 out of the transfer nipping portion. Specifically, the load torque decreases due to the upward force P of the transfer roller 17. Namely, when the rotating direction of the opposite roller 14 and the transport direction of the transfer material 20 shown in FIG. 3 are reversed, a load torque variation occurs in a direction such that the signs become minus (opposite) in Equations (7) and (8). Thus, the position variation of the photosensitive belt 10 takes place toward the plus side.

In the above model, the opposite roller 14, the transfer roller 17, and the transfer material 20 are considered to be rigid bodies; the qualitative tendencies, however, do not change in the case of elastic bodies.

Figure 4:
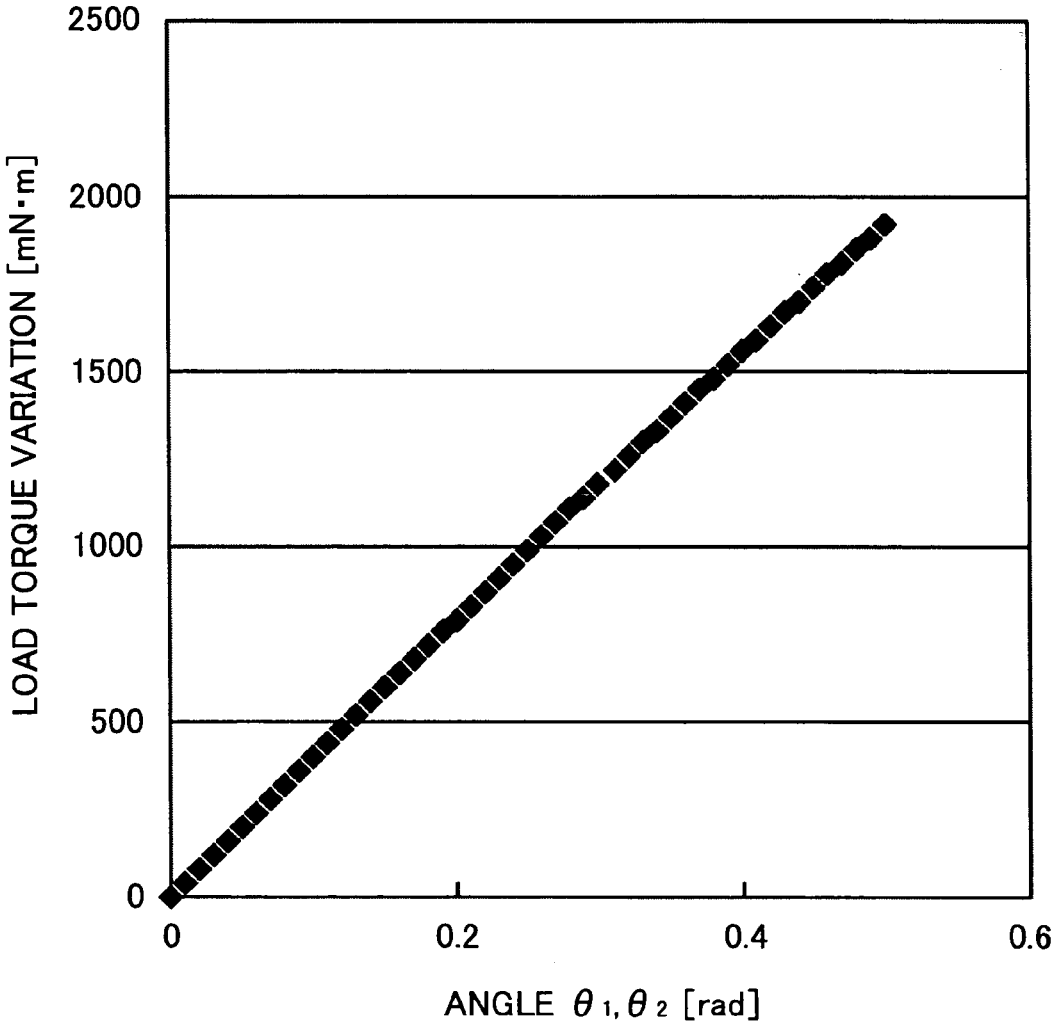
FIG. 4 shows a graph indicating a calculated load torque variation.

FIG. 4 shows a graph indicating the load torque variation calculated by Equations (7) and (8). The vertical axis shows the load torque variation, and the horizontal axis shows the angles $\theta_1$ and $\theta_2$ indicating the position of the transfer material 20 relative to center of the transfer nip. For convenience' sake, the opposite roller 14 and the transfer roller 17 are considered to have the same diameter so that the two angles are equal at all times.

The angles $\theta_1$, $\theta_2$ are alternate angles with respect to the angles $\theta_3$, $\theta_4$, respectively, of FIG. 3. These angles decrease as the rollers rotate and the transfer material 20 moves toward the center of the nipping portion. The calculation results indicate that the greater the angles, the greater the load torque. Namely, the load torque variation is the greatest immediately after the entry of the transfer material 20 into the transfer nipping portion, and decreases as the transfer material 20 is transported through the transfer nipping portion.

Figure 5B:
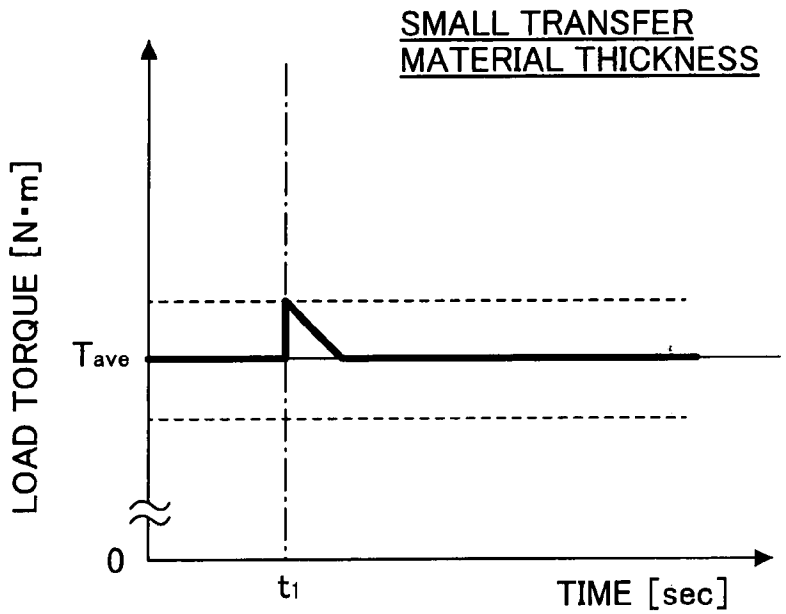
FIG. 5B shows a graph indicating a shift in load torque variation upon entry of a transfer material with a small thickness.
Figure 5A:
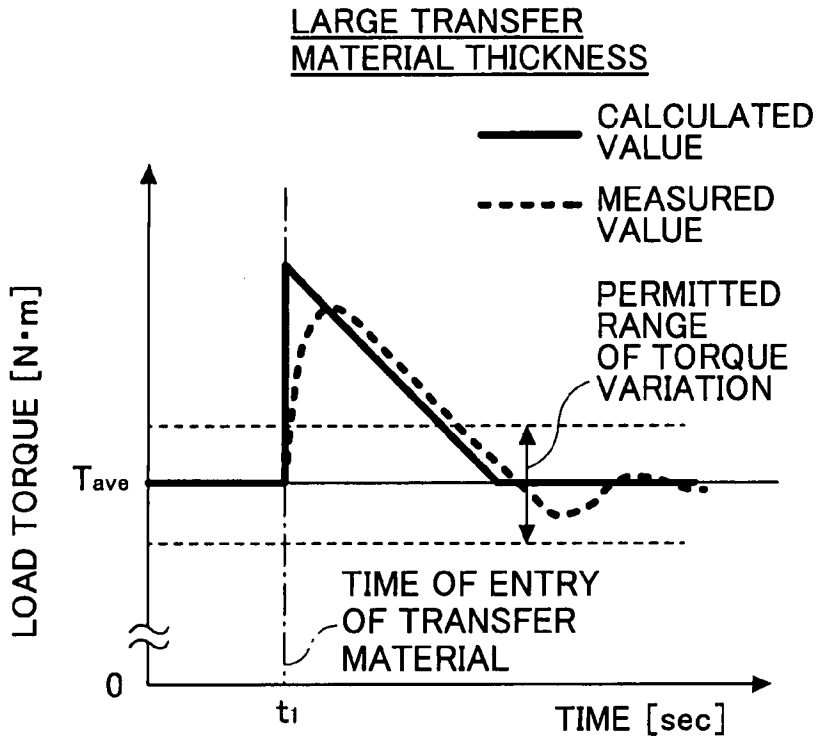
FIG. 5A shows a graph indicating a shift in load torque variation upon entry of a transfer material with a large thickness.

FIGS. 5A and 5B show graphs indicating the shift in the load torque variation upon entry of the transfer material 20. FIG. 5A is the case of a thick sheet of transfer material, while FIG. 5B is the case of a thin sheet of transfer material. The horizontal axis of the graph shows time; time $t_1$ is when the transfer material 20 enters the transfer nipping portion. The vertical axis shows the shift in the load torque applied to the rotating shaft of the opposite roller 14 over time. Load torque $T_{ave}$ is a steady load torque when the opposite roller 14 is rotating at a desired constant angular velocity. A torque variation acceptable range, as indicated by a pair of horizontal broken lines, is the acceptable range of variation of the torque applied to the opposite roller 14. The torque variation acceptable range may be determined by the torque acceptable value of the drive motor and the rigidity of the drive force transmitting system (and possibly an acceptable range of image degradation). When the load torque exceeds this range, the motor rotation speed decreases, or a deformation occurs in the drive force transmitting system (including gears, gear fastening portions, and shaft couplings). As a result, the speed variation in the photosensitive belt 10 and the speed variation in the transfer material 20 increases to such an extent the image quality is greatly degraded.

In FIG. 5A, a result of calculating the load torque variation based on Equations (7) and (8) is indicated by a solid line, while an actual measurement result is indicated by a dotted line. Their tendencies are substantially identical, suggesting the validity of the mechanism of the development of the load torque variation described above. The difference between the calculated and measured values is due to the deformation of the elastic members on the surfaces of the transfer roller 17 and the opposite roller 14. Reduction in the load torque variation can be expected by coating the roller surface with an elastic member, or making the roller members elastic bodies.

The reason why the load torque varies depending on the thickness of the transfer material is discussed below. When the thickness of the transfer material 20 is large (FIG. 5A), the load torque variation greatly exceeds the acceptable range. On the other hand, when the thickness is small (FIG. 5B), the load torque variation is small and within the acceptable range.

The difference in the shift in load torque variation depending on the thickness is explained with reference to the above static model analysis. The position of the contact surface m of the transfer material 20 upon entry into the roller pair shown in FIG. 3 varies depending on the thickness t of the transfer material 20. When the thickness t is smaller, the contact surface m of the transfer material 20 upon entry into the nipping portion is located closer to the center of the transfer nip position. As the thickness t increases, the contact surface m of the transfer material 20 is positioned more and more away from the center of the nipping portion. When the contact surface m of the transfer material 20 is closer to the center of the transfer nipping portion, angles $\theta_1$ and $\theta_2$ are smaller; as the contact surface m is located farther, these angles also become greater. Thus, a difference is caused in the load torque variation value based on Equations (7) and (8) upon entry into the nipping portion. Further, as the thickness t of the transfer material increases, the area in which the load torque variation is caused is extended. This is because the distance between the position of entry of the transfer material 20 into the nipping portion and the center of the nipping portion increases as the thickness of the transfer material 20 increases.

In accordance with an embodiment of the invention, the distance between the axes of the rollers is increased so that the contact surface m of the transfer material is located closer to the center of the nipping portion upon entry thereto (thereby reducing the angles $\theta_1$ and $\theta_2$).

Based on the above analysis made with reference to FIG. 5, it is seen that a high quality image output can be realized by keeping the load torque variation value upon entry of the transfer material into the nipping portion within an acceptable value. With reference to the static model of FIG. 3, by maintaining a constant position of the contact surface m of the transfer material upon entry regardless of the transfer material thickness, the load torque variation upon entry into the nipping portion can be kept to a constant value. Furthermore, by positioning the contact surface m of the transfer material upon entry into the nipping portion such that the load torque variation stays within an acceptable range regardless of the transfer material thickness, a high quality image output can be realized.

In practice, however, it is difficult to monitor and control the contact surface m of the transfer material upon entry into the nipping portion. Particularly, when an elastic member is used in the rollers, because the elastic member deforms over time in varying degrees depending on its environment, it becomes difficult to accurately locate the contact surface m upon entry into the nipping portion. Thus, in accordance with an embodiment of the present invention, a mechanism is employed to regulate the axial position of the transfer roller 17, which is movable in the vertical direction. By regulating the axial position of the transfer roller 17 and thus the center distance between the opposite roller 14 and the transfer roller 17, the position of the contact surface m of the transfer material upon entry into the nipping portion can also be changed. Thus, by controlling the axial position of the transfer roller 17, the center distance between the opposite roller 14 and the transfer roller 17 is controlled so that the load torque variation stays within an acceptable range.

Based on the above analysis, an image transfer apparatus according to a first embodiment is described. In the image transfer apparatus of the present embodiment:

(1) The axial position of the transfer roller 17 is regulated.

(2) The axial position of the transfer roller 17 is set in an effective manner depending on the thickness of the transfer material (thus forming a gap between the shafts of the rollers).

(3) The axial position (ratchet interval) is regulated so that the load torque variation stays within an acceptable range.

(4) The axial position (ratchet backlash) is regulated so that a sufficient pressing force can be given to the transfer material.

Each of these features of the present embodiment is described in the following.

(1) Axial Position Regulation

Figure 6:
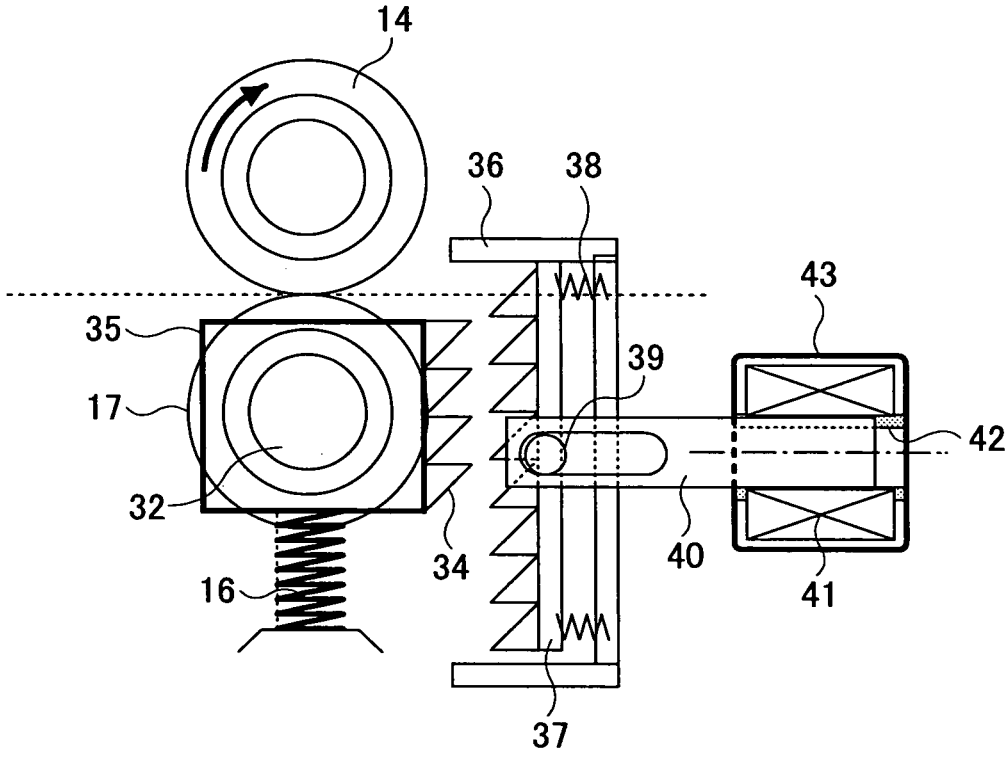
FIG. 6 schematically shows an axial position regulating unit for a transfer roller.

FIG. 6 shows an example of an axial position regulating unit for the transfer roller 17. This is a mechanism for maintaining a roller center distance when the transfer material is in the nipping portion, as described below. The retaining mechanism employs a one-way clutch that is freely movable in the roller-lowering direction while it is locked in the roller-raising direction. The example shown in FIG. 6 employs a ratchet-type one-way clutch. The transfer roller 17 has a rotating shaft 32 that is supported by a bearing member 35 that is movable in the vertical direction. The pressing force of the compression spring 16 is transmitted to the transfer roller 17 via the bearing member 35. To the bearing member 35, a first clutch plate 34 is fixed. Opposite the first clutch plate 34, there is disposed a second clutch plate 37 that can be moved into and out of contact with the first clutch plate 34. The second clutch plate 37 can be horizontally moved by a plate guide member 36 vertically fixed to a casing (not shown). The second clutch plate 37 is biased by a clutch biasing mechanism 38 toward the first clutch plate 34. On the opposing surfaces of the first and the second clutch plates 34 and 37, saw-toothed projections are formed such that, when the first and the second clutch plates 34 and 37 are engaged, they can be locked. Specifically, the clutch mechanism regulates (locks) the movement of the transfer roller 17 in the biasing direction of the compression spring 16 (i.e., the upward direction in FIG. 6).

On the other hand, in the direction opposite to the biasing direction of the compression spring 16 (i.e., in the downward direction in FIG. 6), the transfer roller 17 is freely movable. In order to cause the second clutch plate 37 to be separated from the first clutch plate 34, a release mechanism using a pull-type solenoid is used. A solenoid frame 43, which is fixed to the casing not shown, contains a coil 41, a fixed core, and a guide pipe 42. When the coil 41 is energized, a movable core 40 is drawn into the solenoid frame 43 (i.e., to the right in FIG. 6). The movable core 40 as it is drawn causes the second clutch plate 37 to be moved toward the solenoid against the force of the clutch biasing member, via a plate shaft 39 fixed to the second clutch plate 37. Thus, the first clutch plate 34 is unlocked.

The clutch biasing mechanism 38 may employ a plate spring or a rubber material, other than the compression spring. The clutch-plate release mechanism may include a magnetic material fixed to the second clutch plate 37 so that the second clutch plate 37 can be drawn directly by the solenoid.

(2) Formation of a Gap Between Roller Shafts

Figure 7A:
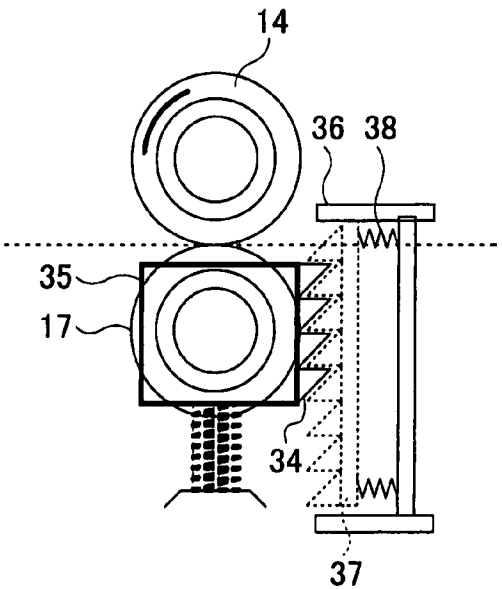
FIG. 7A shows a step in a sequence of operation for forming a gap between the shafts of rollers in an embodiment of the invention.
Figure 7B:
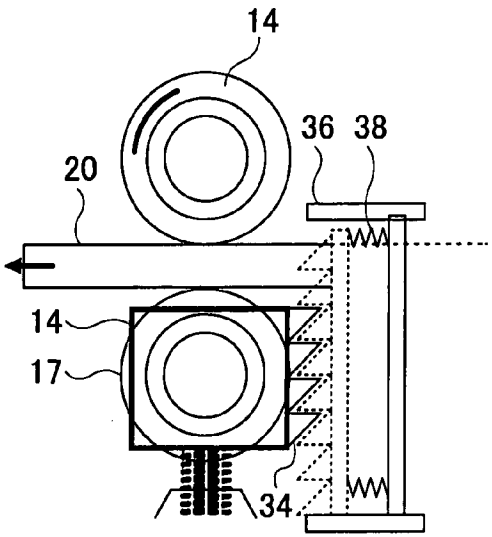
FIG. 7B shows another step in the sequence of operation for forming a gap between the shafts of rollers.
Figure 7C:
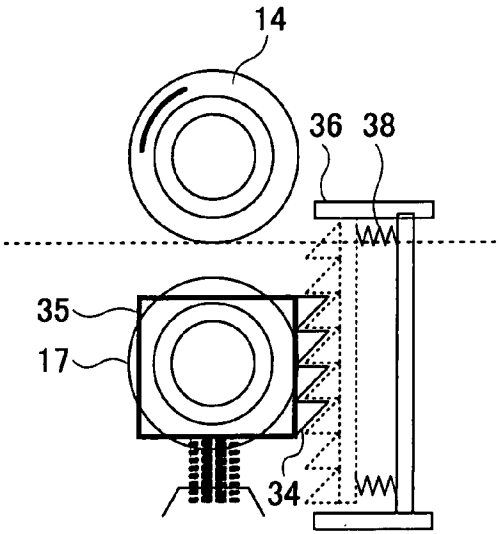
FIG. 7C shows another step in the sequence of operation for forming a gap between the shafts of rollers.

A method of setting an effective axial position of the transfer roller 17 depending on the thickness of the transfer material 20 is described. FIGS. 7A, 7B, and 7C show a series of operations for forming a gap between the roller shafts in the present embodiment. FIG. 7A shows an initial state of the rollers 14, 17 prior to the passage of the transfer material 20. As shown, the opposite roller 14 and the transfer roller 17 are in contact with each other, with the first clutch plate 34 engaged with the second clutch plate 37 by the clutch biasing mechanism 38. In this initial state, a sheet of the transfer material 20 is test-transported in order to form a required gap between the roller shafts. FIG. 7B shows the transfer material 20 passing the nipping portion between the rollers 14, 17. As the transfer material 20 is test-transported, the transfer roller 17 is moved downward. At the same time, the first clutch plate 34 also moves down while engaged under pressure with the second clutch plate 37. As a result, a gap corresponding to the thickness of the transfer material is formed between the roller shafts. After the rear-end of the transfer material 20 has passed the nipping portion, the axial position is maintained as shown in FIG. 7C. Because the first and the second clutch plates 34, 37 are still engaged under pressure, the upward movement of the transfer roller 17 is prevented. Thus, the gap corresponding to the thickness of the transfer material 20 can be maintained. In practice, however, there is some play or backlash in the ratchet intervals of the clutch portion or between the second clutch plate 37 and the plate guide member 36, resulting in a smaller center distance than as shown in FIG. 7B. By transporting the subsequent sheets of the transfer material 20 in the state of FIG. 7C, the load torque variation that is caused can be greatly reduced.

When the transport of a series of sheets of the transfer material 20 with the same thickness is completed and another series of sheets of the transfer material 20 with a different thickness is to be transported, the first clutch plate 34 and the second clutch plate 37 are separated in a clutch releasing operation, whereby the initial state of FIG. 7A is resumed and a test transport is conducted again. Preferably, the clutch releasing operation is performed when the final transfer sheet with the initial thickness is in the nipping portion between the rollers; i.e., in the state of FIG. 7B. This is because it is easier to move the second clutch plate 37 horizontally in the state of FIG. 7B than that of FIG. 7C, so that the clutch can be released more smoothly. When the clutch is released in the state of FIG. 7B, a load torque variation is caused upon exit of the rear end of the final sheet out of the nipping portion. However, the problem of image degradation does not easily occur once the image forming operation is completed.

While it is assumed in the example of FIGS. 7A to 7C that the roller members are made of metal or the like and that there is no deformation in the roller surfaces, the same effect can be obtained with the same operation when the roller members are made of elastic material such as rubber, with surface deformation. Any deformation that may occur in the elastic member on the roller surface or in the pressure roller shaft occurs in the same amount in response to the same pressing force, whether in the initial state of FIG. 7A or the nipping state of FIG. 7B. Thus, the amount of change in the roller center distance from FIG. 7A to FIG. 7B still corresponds to the thickness of the transfer material 20. Therefore, the same effect can be obtained by maintaining a gap between the roller shafts that corresponds to the thickness of the transfer material 20.

The test transport of the first sheet of the transfer material 20 is described below. In the present embodiment, the test transport is conducted in order to form a gap between the roller shafts. At the time of the initial test transport, the load torque reducing effect of the present embodiment is not obtained. Thus, preferably, some measure is taken in light of the configuration of the image forming apparatus. In the following, two examples of such measure are described.

The first measure is to avoid the formation of an image during the test transport. The sheet after the test transport may be recycled by the user, or it may be fed back to a re-feeding path for automatic both-side printing. A re-feeding operation may be carried out by reversing the direction of feeding.

The second measure is to transport the first sheet and perform image formation at slower speed. In this case, a stepping motor or a DC servo motor may be used as the drive motor, and the motor shaft or the opposite roller 14 is rotated at constant speed. By performing a test transport at reduced speed, the load torque also varies slowly, so that it becomes possible for the motor to supply a torque sufficient for the load torque variation, thereby reducing the influence of the load torque variation.

In the axial position regulating unit, the ratchet pitch, i.e., the interval of the peaks of any two projections on the first clutch plate 34 and the second clutch plate 37, should be no greater than a distance corresponding to the permitted torque variation range; the smaller the ratchet pitch, the better. The distance corresponding to the permitted torque variation range may be determined by conducting a transfer material transport experiment. In one such experiment, when the variation in the load torque applied to the opposite roller 14 was measured by passing multiple sheets of transfer material with different thicknesses, the variation stayed within the acceptable range up to a thickness of 200 μm. Accordingly, the movement of the transfer roller in the vertical direction upon the entry and exit of the transfer material should be equal to 200 μm or smaller. Therefore, the ratchet pitch should be 200 μm or smaller. In accordance with the present embodiment, the ratchet pitch is set to be approximately 70 μm by taking into consideration the backlash in the ratchet portion, as will be described below. A ratchet pitch greater than 70 μm may result in exceeding the permitted torque variation.

Between the second clutch plate 37 and the plate guide member 36, a play, or a backlash, is provided. The backlash may be provided between the first clutch plate 34 and the bearing member 35. During the transport of the transfer material 20 as shown in FIG. 7B, the second clutch plate 37 contacts the lower surface portion of the plate guide member 36 as the transfer roller 17 is pressed down. After the transport as shown in FIG. 7C, the second clutch plate 37 is moved upward by the transfer roller 17 by an amount corresponding to the backlash, so that the second clutch plate 37 contacts the upper surface portion of the plate guide member 36. Such a backlash is provided in order to provide a desired pressing force during the transport of the transfer material in the state of FIG. 7B. If there is no such backlash, the second clutch plate 37 would contact the upper surface portion of the plate guide member 36 where a pressing force would be applied, so that the pressing force applied to the transfer material would be reduced. Ideally, a backlash of as little as 1 μm can give a desired pressing force to the transfer material. In practice, however, the backlash needs to be set by taking into consideration the following variation factors (1) to (4) between the roller shafts:

(1) Variations due to changes in the environment (such as temperature and humidity) caused by the continuous passage of a large number of sheets of the transfer material.

(2) Variations due to different amounts of deformation of the elastic member around the roller surfaces that are caused by hardness variations.

(3) Variations due to the eccentricity of the rollers.

(4) Variations due to thickness variation in plural sheets of the transfer material of the same type, or variation in the thickness of an individual sheet.

Figure 8:
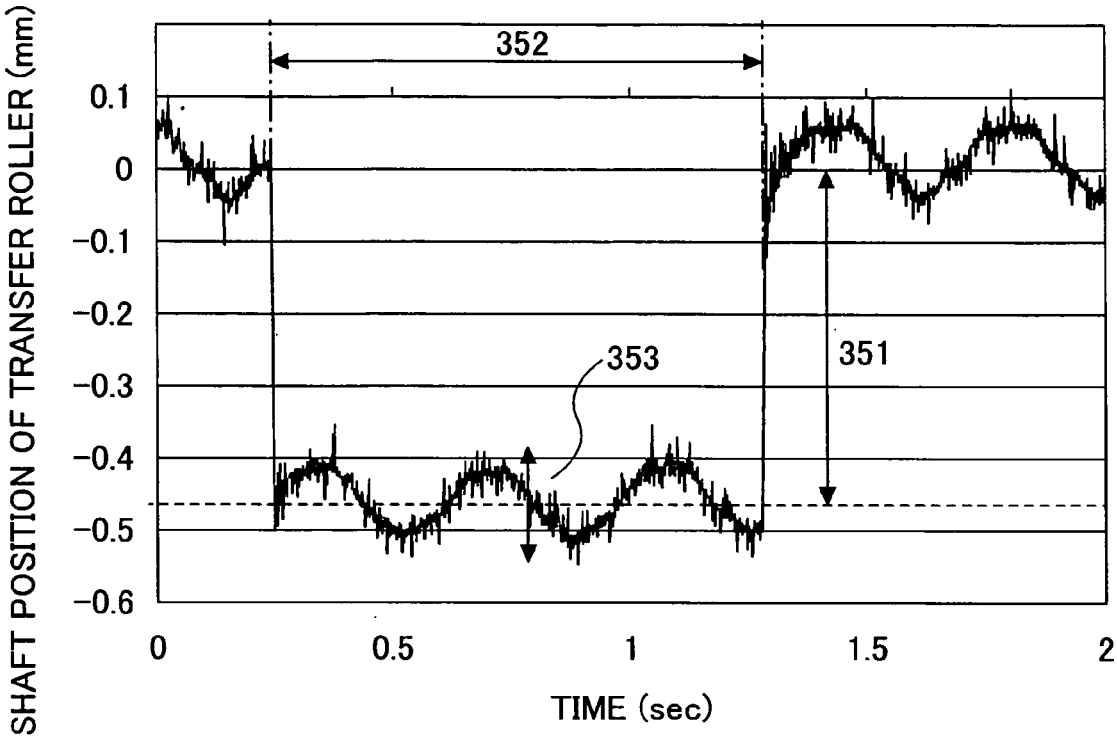
FIG. 8 shows a graph indicating a result of measuring the axial position of a transfer roller as a sheet of transfer material is passed.

FIG. 8 shows a graph of a result of measuring the axial position of the transfer roller 17 when feeding a copy paper into the image transfer apparatus. In the graph, the horizontal axis shows time and the vertical axis shows the roller axial position, with the roller axial position in the initial state of FIG. 7A taken as a reference (0) position. A time band 352 in FIG. 8 indicates the time interval in which the transfer material passed the nipping portion as shown in FIG. 7B. In the time band 352, the transfer roller 17 is pushed down by approximately 460 μm, as indicated by a variation interval 351, which corresponds to the thickness of the transfer material. Further, as indicated by a variation interval 353, there is an axial position variation of approximately 110 μm that is due to the aforementioned multiple factors of the inter-axial variations. The backlash amount is set to be a variation peak-to-peak (P-P) value by taking into consideration the above variation factors in order to apply a desired pressing force to the transfer material at all times. Specifically, in the present embodiment, the backlash amount is set to be the P-P value of the variation, which is approximately 120 μm when environmental changes as well as the experimental data are considered. The amount of backlash may be made adjustable in order to handle low-quality transfer material having a large thickness variation.

The total of the ratchet pitch and the backlash amount is the maximum amount of lowering of the transfer roller 17 from the retained state of FIG. 7A to the time at which the transfer material passes as shown in FIG. 7B. Thus, the total of the ratchet pitch and the backlash amount is designed to be less than 200 μm, which is the load torque variation acceptable range. In the present embodiment, where the ratchet pitch width is set to 70 μm and the backlash amount is set to 120 μm, the maximum amount by which the transfer roller is pushed up in the shaft-position-retained state of FIG. 7C as the transfer material passes the nipping portion is 190 μm, thus staying within the acceptable range. For example, when the aforementioned copy paper is fed, the transfer roller is pushed down by the maximum amount of variation in FIG. 8, or about 510 μm. Thus, the first clutch plate and the second clutch plate are relatively displaced by an amount corresponding to the six teeth of the ratchet, so that the transfer roller is retained at the shaft position of about −490 μm. However, because there is the backlash of 120 μm, the actual roller shaft position is about −370 μm. In the state where such an axial position is maintained, when the transfer material is transported, the amount of pushing-up of the transfer roller 17 varies within the variation width 353 of FIG. 8, or between about 20 to 140 μm, thus sufficiently staying within the acceptable range.

Hereafter, a roller outer-shape retaining mechanism according to a second embodiment is described. Of the axial position variations shown in FIG. 8, the variation component that occurs at the period of about 0.36 second is mainly due to the eccentricity in the opposite roller 14 and the transfer roller 17. In an experiment, because the two rollers had the same diameter and had an eccentricity of approximately 50 to 60 μm each, the both variations were superposed upon each other, creating a variation width of approximately 110 μm. In order to provide a constant pressing force to the opposite roller 14 when there is such a center distance variation, the backlash amount is set to be not less than the aforementioned variation width. If the backlash amount is greater, it would be necessary to reduce the ratchet pitch of the clutch plates, which would require stricter machining or forming conditions and result in an increase in manufacturing cost. Thus, in order to overcome this problem, a retaining mechanism for the transfer roller 17 is adopted that is not readily affected by the roller eccentricity.

Figure 9:
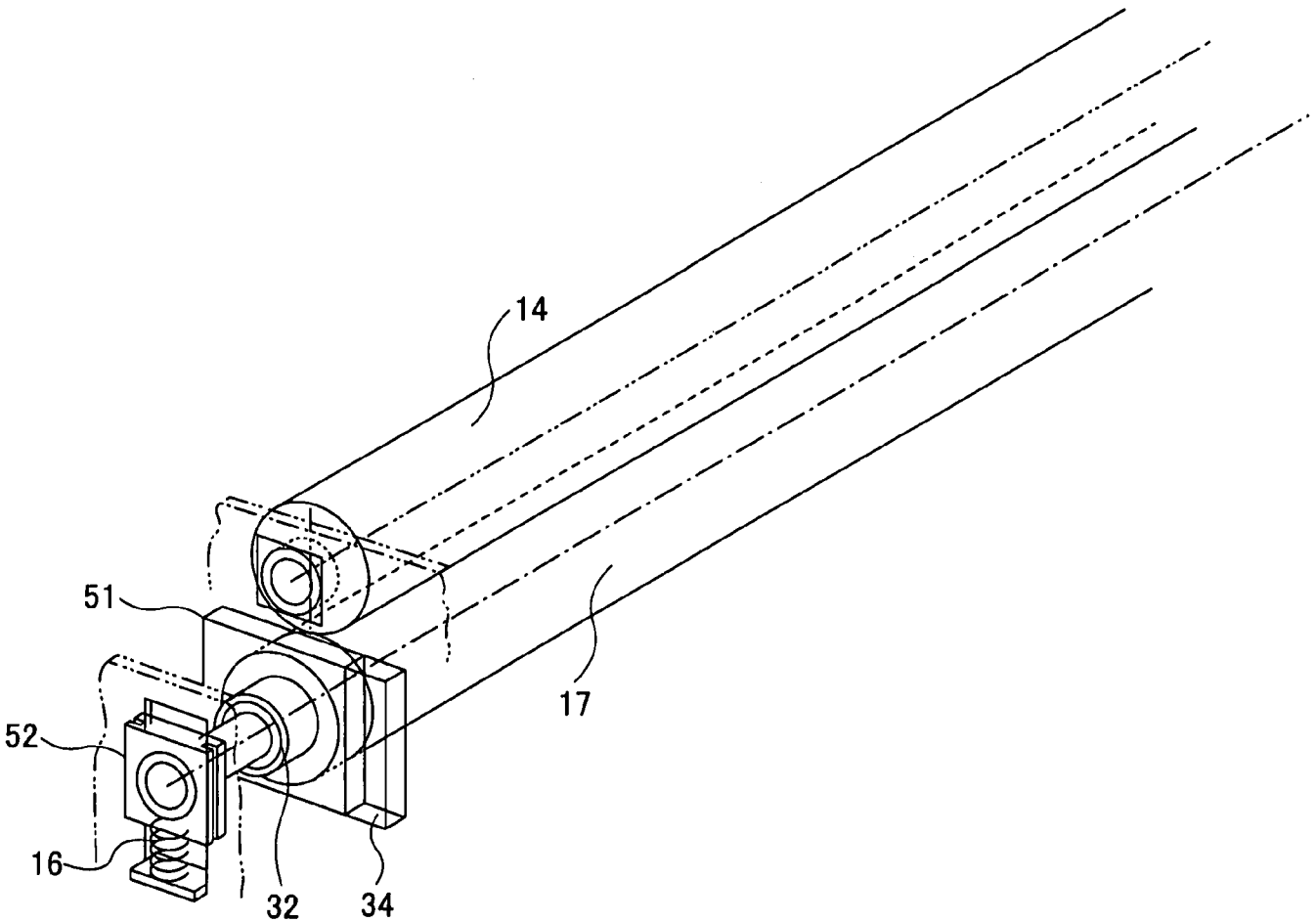
FIG. 9 schematically shows a retaining mechanism according to another embodiment of the invention.

FIG. 9 schematically shows the retaining mechanism according to the second embodiment. In the present embodiment, a bearing portion 51 is adopted for retaining the outer-shape portion of the transfer roller. To the bearing portion 51, the first clutch plate 34 is fixed, thereby forming a one-way clutch. By adopting the mechanism for retaining the outer-shape portion of the transfer roller 17, the influence of the eccentricity in the transfer roller 17 can be reduced. When the position variation of the bearing portion 51 was measured, the variation at the period of 0.36 second was reduced by half. Thus, the ratchet pitch can be increased. In the present embodiment, the rotating shaft 32 of the transfer roller 17 is placed on a bearing portion 52, and the transfer roller 17 is pressed against the opposite roller 14 by a compression spring 16.

In the retained state of FIG. 7C, when the surfaces of the opposite roller 14 and the transfer roller 17 are separated, the transfer roller 17, which does not have its own drive source, stops rotating. Thus, preferably, a driving force transmitting mechanism is provided to rotate the transfer roller 17. Upon entry of the transfer material into the nipping portion, a torque is required to sharply increase the speed of the transfer roller 17 from a stop condition to the transfer material transport speed, thus providing a factor for the transfer material transport speed variation. Thus, the driving force transmitting mechanism is installed so that the transfer roller 17 can rotate at the same speed as the opposite roller 14 even when the surface of the transfer roller 17 is spaced apart from that of the opposite roller 14. Specifically, gears may be fixed to the shafts of the opposite roller 14 and the transfer roller 17 such that the rotation of the opposite roller 14 can be transmitted to the transfer roller 17. The tooth height of the gears may be designed so that the gears can engage with each other when the both rollers are separated. Alternatively, a separate drive source may be provided for the transfer roller 17 and driven so that the transfer roller 17 can rotate at the same speed as the opposite roller 14.

Figure 10A:
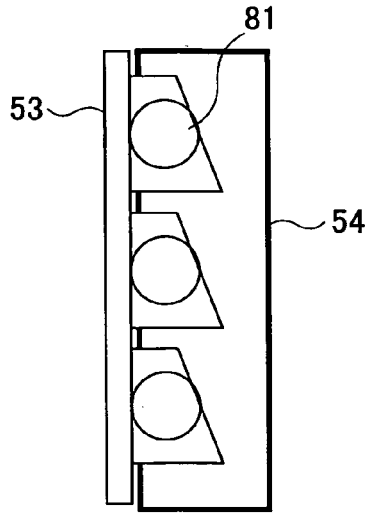
FIG. 10A shows a roller-type one-way clutch according to an embodiment of the invention where the clutch is engaged.
Figure 10B:
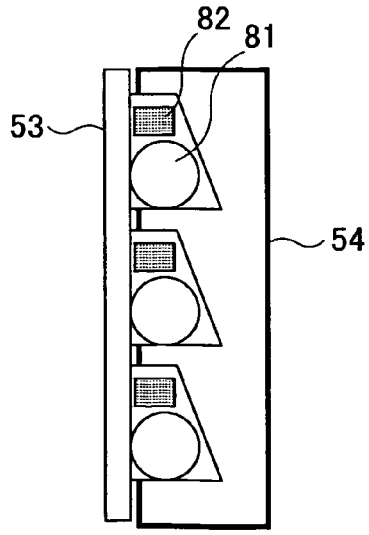
FIG. 10B shows the roller-type one-way clutch according to the embodiment of FIG. 10A where the clutch is released.

Alternatively to the ratchet-type, the one-way clutch may be of the roller type. FIG. 10 schematically shows a roller-type one-way clutch. As a slide plate 53 moves in the upper direction, rollers 81 disposed in a housing 54 are wedged between the housing 54 and the slide plate 53, thereby regulating the movement of the slide plate 53 in the upper direction. The regulation may be released by inserting a tapered clutch release nail 82 into the roller-wedged portion. By adopting such a roller-type clutch, it becomes possible to retain the position of the transfer roller in a stepless manner. The amount of wedging movement may be controlled by a backlash amount. In another example, the clutch mechanism may employ an electromagnetic mechanism that is well known.

While the foregoing description has been mainly concerned with the actions involved upon entry of the transfer material in the present embodiment, the same effects can be obtained with regard to the torque variation upon exit of the transfer material.

In the following, a third embodiment of the present invention is described. In the foregoing embodiment, the clutch mechanism is mounted on the bearing member for the rotating shaft or the outer-shape portion of the transfer roller 17. When the acceptable amount of movement of the transfer roller based on the load torque acceptable variation range is 1 mm or smaller, it is necessary to set the ratchet pitch on the order of several tens to several hundreds of μm. It also becomes necessary to ensure sufficient rigidity for retaining the transfer roller against the pressing force. Thus, an arm member is adopted in order to increase the ratchet pitch and to reduce the rigidity required of the clutch.

Figure 11:
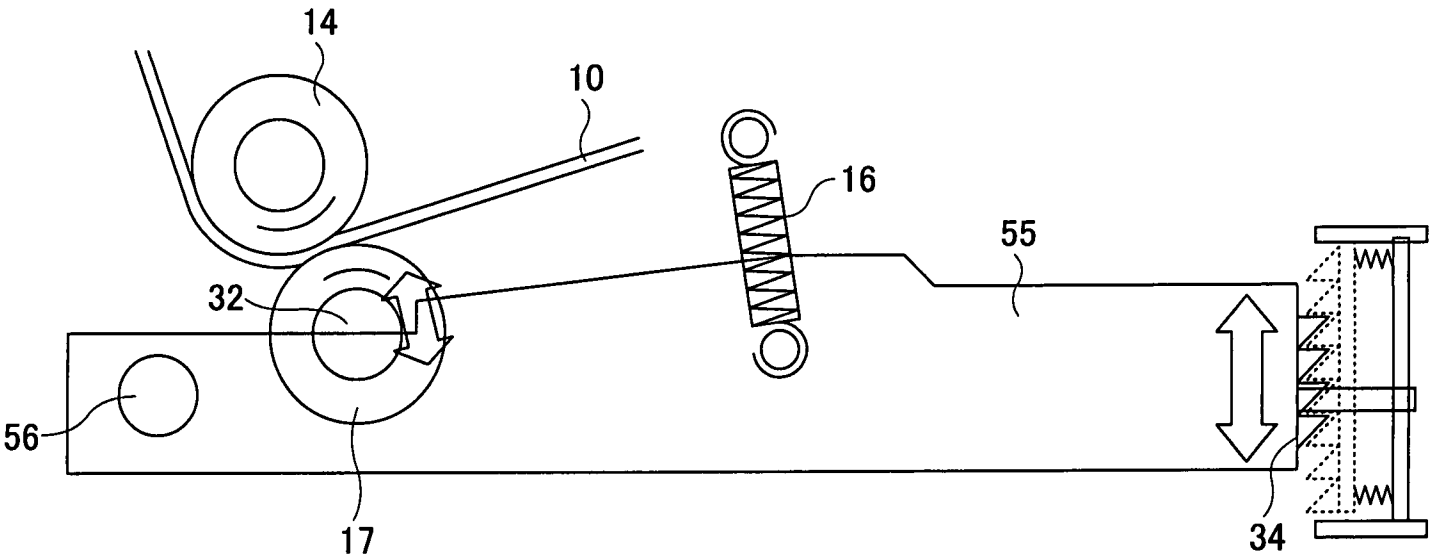
FIG. 11 shows an image transfer apparatus according to another embodiment of the invention.

FIG. 11 schematically shows an image transfer apparatus according to the third embodiment. An arm member 55 moves about a rotating shaft 56 and includes a bearing portion for supporting a rotating shaft 32 or an outer diameter portion of the transfer roller 17. The arm member 55 also transmits the pressing force of the compression spring 16 to the transfer roller 17. At the end of the arm member 55, the first clutch plate 34 is disposed, thereby forming a one-way clutch. By thus employing an arm member, the amount of vertical movement of the transfer roller 17 and the amount of movement of the first clutch plate 34 increase in accordance with the ratio of the distance between the rotating shaft 32 of the transfer roller 17 and the rotating shaft 56 to the distance between the rotating shaft 56 of the arm member 55 and the first clutch plate 34. The rigidity for retaining the position of the transfer roller 17 can also be reduced. Thus, a less expensive clutch mechanism can be adopted.

In the image transfer apparatus according to the third embodiment, a retaining operation similar to those of the first and the second embodiments is performed. Instead of the ratchet-type one-way clutch shown, a roller-type one-way clutch may be employed. Further, a rotary clutch may be adopted at the rotating shaft 56 of the arm member 55.

Image Forming Apparatus

Figure 12:
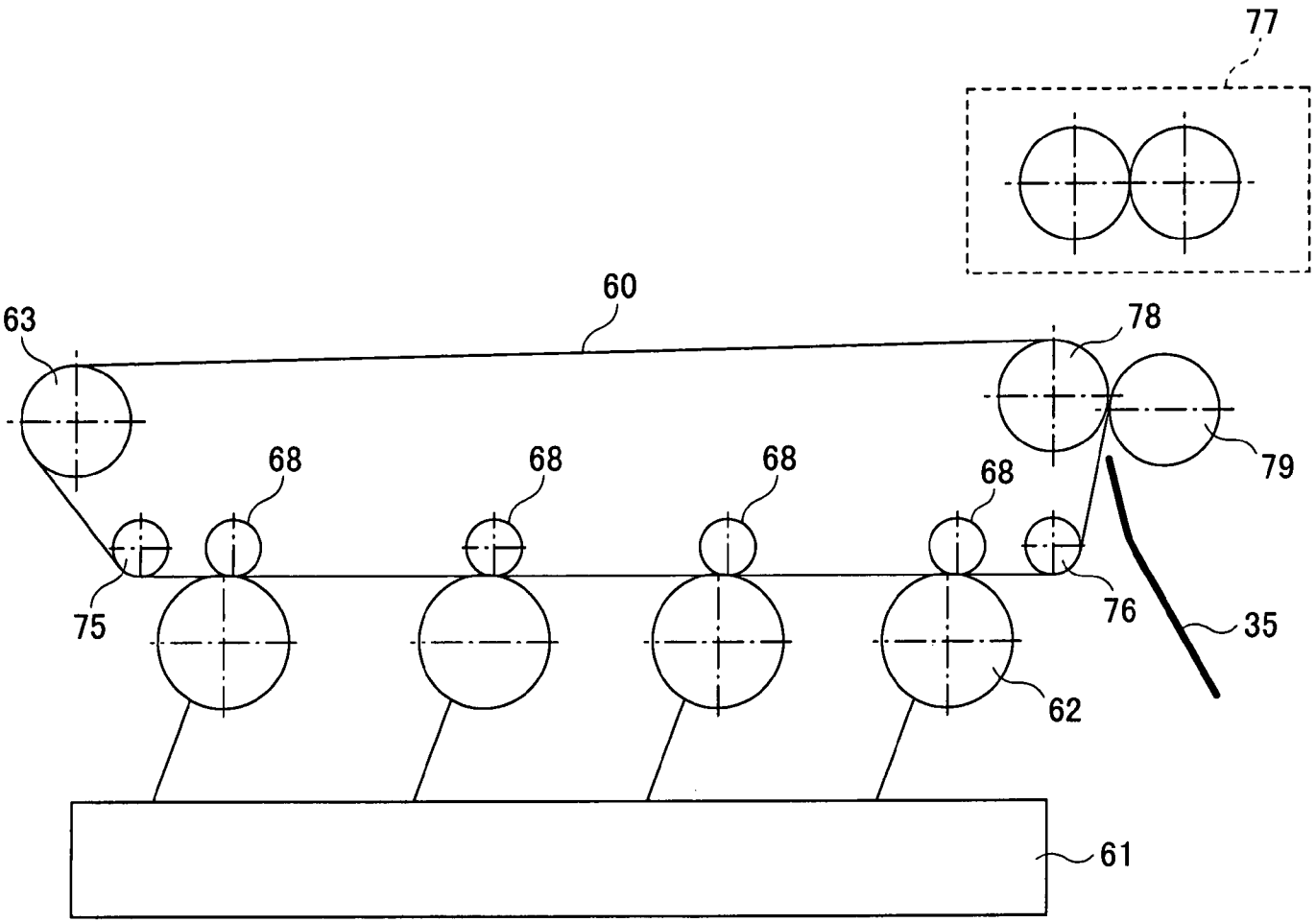
FIG. 12 schematically shows an image forming apparatus according to another embodiment of the present invention.

Hereafter, a description is given of an image forming apparatus in which a transfer apparatus and a fixing apparatus are used, with reference to the drawings. The image forming apparatus may be employed in a copy machine or a printer comprising a main component portion and a paper feed table retaining a large number of sheets, in which a scanner may be installed on the main component portion, or an automatic document feeder (ADF) may be further installed thereon. FIG. 12 schematically shows the image forming apparatus. The image forming apparatus is a tandem-type electrophotographic apparatus using an intermediate transfer system.

The image forming apparatus includes an intermediate transfer belt 60 consisting of an endless belt which is an image carrier and an intermediate transfer material. The intermediate transfer belt 60 is extended across four supporting rotating bodies, i.e., support rollers 63, 78, 75, and 76, and is rotated in the anti-clockwise direction in the drawing. An intermediate transfer belt cleaning apparatus, not shown, is provided to the left of the support roller 63 for removing toner that remains on the intermediate transfer belt 60 after image transfer. Between the support rollers 75 and 76 along the belt movement direction, there is disposed a tandem image forming portion consisting of image forming units for the colors of yellow (Y), cyan (c), magenta (M), and black (K). Each of the image forming units includes an image carrier drum 62 that rotates in the clockwise direction, and a bias roller 68. Around each of the image carrier drums 62, which are photosensitive, there are disposed various apparatuses including a charging apparatus, a developing apparatus, and a cleaning apparatus, which are not shown. The individual image forming units are similarly configured, with the bias roller 68 disposed opposite the image carrier drum 62 across the intermediate transfer belt 60. In the present embodiment, the support roller 78 is the drive roller. Under the tandem image forming portion, there is disposed an exposing apparatus 61 as a latent image forming unit.

Opposite the support roller 78 across the intermediate transfer belt 60, there is disposed a secondary transfer roller 79 as a secondary transfer unit. The secondary transfer roller 79 is pressed against the support roller 78 via the intermediate transfer belt 60, so that an image on the intermediate transfer belt 60 can be transferred onto a recording material sheet 35. A load torque variation control mechanism including a nipping mechanism according to an embodiment of the invention is disposed at the rotating shaft of the secondary transfer roller 79. Thus, the load torque variation at the secondary transfer apparatus nipping portion during sheet transport can be reduced, whereby the speed variation in the intermediate transfer belt 60 and the sheet transport speed variation can be reduced. Above the secondary transfer roller 79, there is disposed a fixing apparatus 77 for fixing the image transferred onto the sheet 35. A load torque variation control mechanism according to an embodiment that includes a guide slope member is also disposed at the rotating shaft of the roller for providing a pressing force in the fixing apparatus. Thus, the load torque variation caused as the sheet is transported to the nipping portion of the fixing apparatus 77 can be reduced, and also the transport speed variation upon entry of the sheet 35 into the nipping portion of the fixing apparatus 77 is reduced. Thus, the influence on the image during the secondary transfer upon entry of the sheet onto the fixing apparatus 77 in the transfer apparatus is reduced. The aforementioned support roller 78 also has a sheet transport function for transporting the sheet after image transfer to the fixing apparatus 77 by contacting and driving the secondary transfer roller 79. It goes without saying that a secondary transfer apparatus consisting of a transfer belt or a contactless charger may be disposed. The transfer sheet 35 is inserted from below into the nipping portion between the support roller 78 and the transfer roller 79, and a toner image is transferred onto the transfer sheet.

When making a copy using the above image forming apparatus, a manuscript may be placed on a manuscript holder of an ADF. Alternatively, the manuscript may be placed on a contact glass of a scanner by opening the ADF, and then the ADF may be closed to press down on the manuscript. Thereafter, as a start switch (not shown) is depressed, the manuscript, when placed on the ADF, is transported to the upper surface of the contact glass. On the other hand, when the manuscript is placed on the contact glass, the scanner is immediately operated. During the operation of the scanner, a light source emits light onto the manuscript, and the light reflected by the manuscript surface is further reflected and then passed through an imaging lens, and finally the content of the manuscript is read by a pickup sensor. Alternatively, digital image information may be received from a personal computer or a digital camera, for example.

In parallel to the reading of the manuscript or the reception of image information, the support roller 78 is rotated by a drive motor, not shown, as a drive source. Thus, the intermediate transfer belt 60 is rotated in the anti-clockwise direction in the drawing, whereby the remaining support rollers (driven rollers) are driven. Simultaneously, the photosensitive drum 62 as a latent image carrier in each of the image forming units is rotated and exposed, and the image thereon is developed in accordance with individual color information for yellow, cyan, magenta, and black, whereby a toner image (developed image) of an individual color is formed. The toner image on each of the photosensitive drums 62 is then transferred onto the intermediate transfer belt 60 successively in an overlapping manner, whereby a composed color image is formed on the intermediate transfer belt 60.

In parallel to the above image formation, the sheet 35 is transported to the secondary transfer portion. Specifically, one of the paper feeding tables is selected, and sheets are picked one after another out of one of the feeding cassettes provided in multiple stacks in a paper bank. The sheets are separately fed into the feeding path by a separating roller, and then transported and guided by a transport roller onto the feeding path until the sheet abuts against register rollers. Alternatively, a paper-feed roller may be rotated to slide out sheets on a manual feed tray, and the sheets are separated by the separating roller one by one and fed onto a manual feeding path until the sheet abuts against the register rollers. The register rollers are rotated at a timing determined with reference to the composed color image on the intermediate transfer belt 60 in order to feed the sheet into the gap between the intermediate transfer belt 60 and the secondary transfer roller 79, whereby the color image is transferred by the secondary transfer roller 79 onto the sheet. The sheet after image transfer is transported by the secondary transfer roller 79 and the opposite roller into the fixing apparatus 77. In the fixing apparatus 77, the transferred image is fixed by heat and pressure, and then ejected by an ejection roller and stacked on an ejected paper tray.

The intermediate transfer belt 60 after image transfer has the toner remaining thereon removed by the intermediate transfer belt cleaning apparatus (not shown) in order to prepare for the subsequent sequence of image formation in the tandem image forming portion. While the register rollers are generally grounded, a bias may be applied to them in order to remove the powdered paper material of the sheet.

It is also possible to make a black-and-white copy using the image forming apparatus. In this case, the intermediate transfer belt 60 is separated from the photosensitive drums 62 for the colors of yellow, cyan, and magenta by a unit which is not shown, and the photosensitive drums 62 for these three colors are temporarily deactivated. Image formation and transfer are carried out by bringing only the photosensitive drum 62 for black into contact with the intermediate transfer belt 60.

Figure 13:
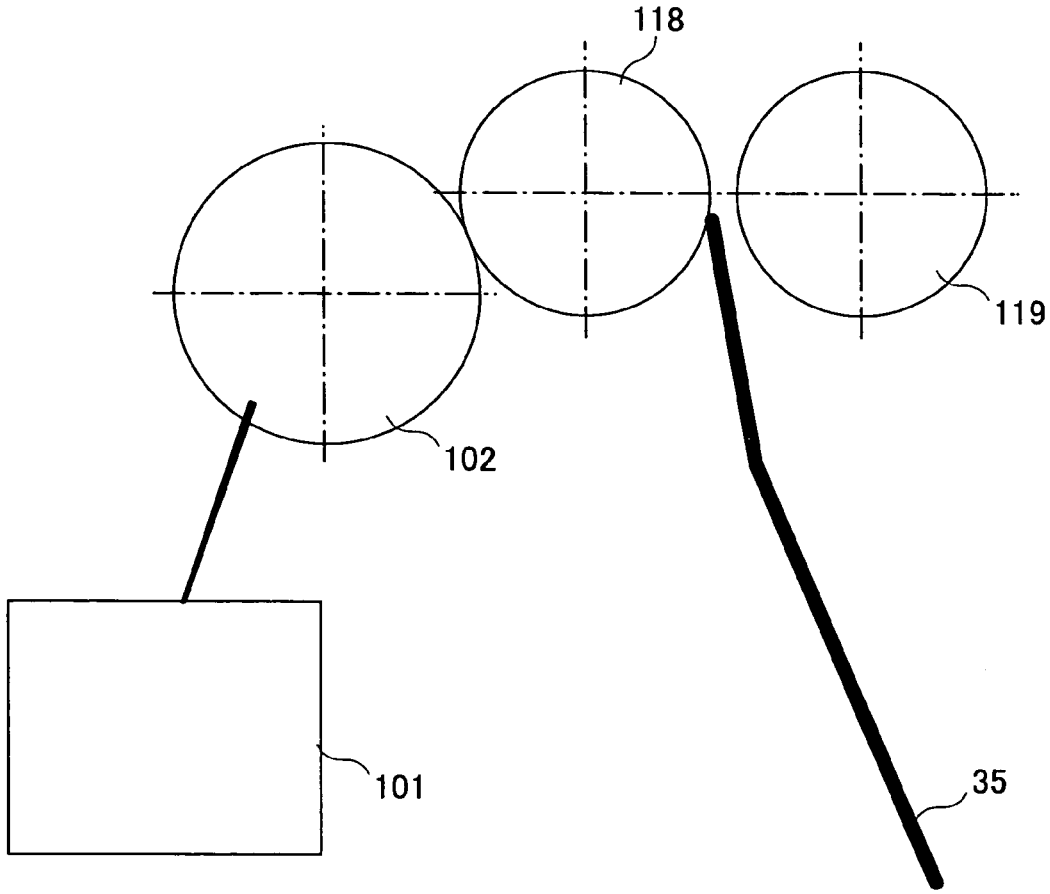
FIG. 13 schematically shows an image forming apparatus according to another embodiment of the invention.
Figure 14A:
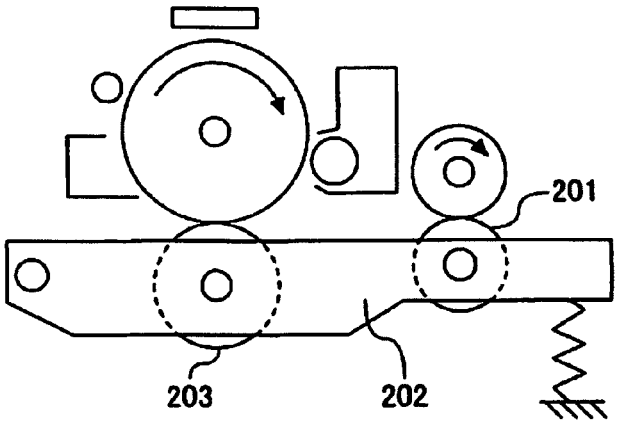
FIG.14A Related Art
FIG. 14A shows a conventional transfer material transport apparatus prior to the entry of a transfer material.
Figure 14B:
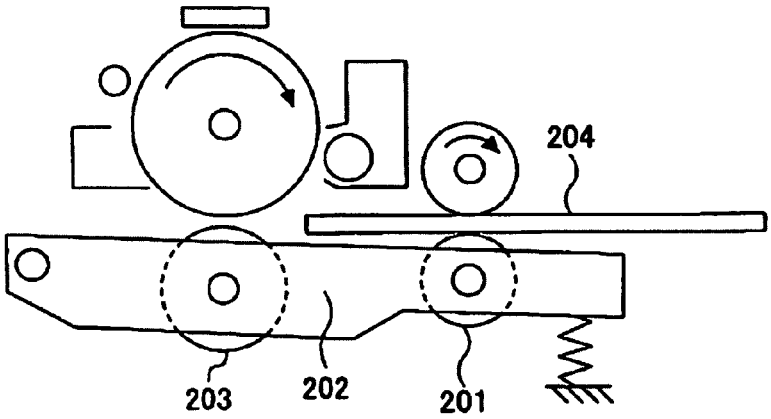
FIG.14B Related Art
FIG. 14B shows the conventional transfer material transport apparatus when the transfer material is travelling on a shifting roller.
Figure 14C:
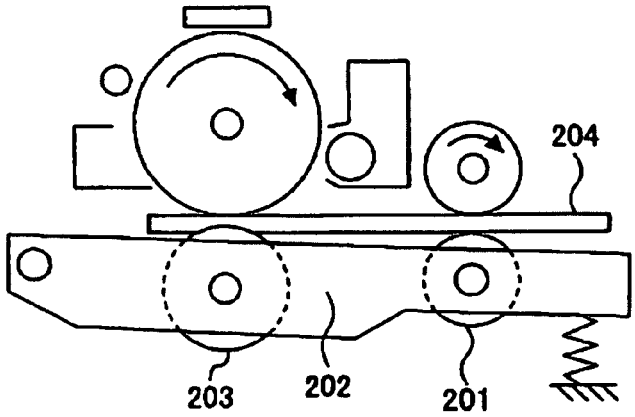
FIG.14C Related Art
FIG. 14C shows the conventional transfer material transport apparatus upon entry of the transfer material into a nipping portion.

Apart from the above-described tandem-type electrophotographic system using the intermediate transfer belt, the image forming apparatus may also be adapted to an electrophotographic system in which an intermediate transfer drum is used. FIG. 13 shows an image forming apparatus according to another embodiment. In the present embodiment, a drive roller 118 has the function of an intermediate transfer drum. Specifically, the drive roller 118 retains and transports an image formed on a photosensitive drum 102, and transfers the image onto a transfer material 35 at a nipping portion between the drive roller 118 and a secondary transfer roller 119. A load torque variation control mechanism including an inter-roller nipping mechanism according to an embodiment of the invention is disposed at the rotating shaft of the secondary transfer roller 119. Thus, the load torque variation at the secondary transfer nipping portion during sheet transport can be reduced, and also the development of the speed variation in the intermediate transfer drum and the sheet transport speed variation can be reduced.

As described above, in accordance with an embodiment of the present invention, a certain distance is maintained between two rollers during the transport of a transfer material. As a result, the amount by which the pressure roller is depressed upon entry of the transfer material can be greatly reduced, and the load torque variation in the transfer material transport drive system can be reduced. Thus, the transfer material transport speed variation caused by the load torque variation can be reduced.

In accordance with another embodiment of the present invention, a one-way clutch mechanism is adopted whereby a certain distance between the two rollers can be easily maintained by merely engaging clutch plates during the transport of the transfer material. Further, by setting a backlash such that the clutch plates can be moved freely by a predetermined distance, a desired pressing force can be applied to the transfer material at all times even when the distance between the two rollers varies due to roller eccentricity or the like.

In accordance with another embodiment of the present invention, a second rotating body is supported via its outer diameter portion rather than its rotating shaft, whereby a certain distance can be maintained between the two rollers without being affected by the eccentricity in the second rotating body.

In accordance with another embodiment of the present invention, an arm member is used whereby, based on the principle of leverage, the retaining torque applied to the clutch mechanism can be reduced compared with the case where the clutch mechanism is disposed on the rotating shaft of the second rotating body. Furthermore, because the amount of movement upon passage of the transfer material can be increased, it becomes possible to adopt an inexpensive clutch mechanism with greater ratchet intervals.

In accordance with another embodiment of the present invention, the two rollers can keep rotating at a transfer material transport speed even when a gap is produced between them by the retaining mechanism. Thus, no torque is required for accelerating one of the rollers that may be stopped or decelerating upon entry of the transfer material into the nipping portion. Thus, the transfer material can be transported stably.

In accordance with another embodiment of the present invention, the transport speed for the initial sheet of the transfer material is reduced, whereby the transfer material transport speed variation upon entry of the transfer material can be reduced by the feedback effect of the motor that is controlled to rotate at a constant speed.

In accordance with another embodiment of the present invention, the initial sheet of the transfer material is test-transported, whereby a certain retained state can be realized. During the test transport, no image formation is carried out and the sheet is fed back to the image forming portion, so that the transfer material is not wasted.

In accordance with another embodiment of the present invention, the initial sheet of the transfer material is test-transported in order to realize a certain retained condition. During the test transport, no image formation is performed, and the sheet is once transported to the nipping portion and then transported back and fed while image formation is performed. Thus, the transfer material is not wasted.

In accordance with another embodiment of the present invention, when transporting a sheet of the transfer material with a different thickness, the retention of distance between the rollers is released upon transport of a final sheet with the initial thickness when the torque applied to the retaining mechanism is small. Thus, the releasing operation can be conducted without damaging the clutch mechanism.

In accordance with another embodiment of the present invention, the load torque variation upon entry of the sheet into the fixing nipping portion is reduced, whereby a high-quality transferred image can be obtained without causing a rotation speed variation in the fixing roller.

Although this invention has been described in detail with reference to certain embodiments, variations and modifications exist within the scope and spirit of the invention as described and defined in the following claims.

The present application is based on the Japanese Priority Application No. 2007-223895 filed Aug. 30, 2007, the entire contents of which are hereby incorporated by reference.

What is claimed is:

1. An image transfer apparatus, comprising:

a first rotating body configured to rotate, by a rotating drive force provided by a drive source, the first rotating body having a non-zero variation width;

a second rotating body opposite the first rotating body, the second rotating body configured to move freely in a pressing direction by a distance no less than the variation width of the first rotating body;

a pressing unit configured to press the second rotating body onto the first rotating body with a pressing force; and a retaining unit configured to maintain a distance between the first rotating body and the second rotating body while the thickness of a transfer material that passes through a nipping portion between the first rotating body and the second rotating body remains the same, wherein at least a portion of the retaining unit is movable in a horizontal direction and a vertical direction relative to the second rotating body, wherein the retaining unit includes a one-way clutch mechanism configured to regulate movement of the second rotating body by the pressing unit in the pressing direction, the retaining unit configured to allow the second rotating body to move freely in a direction opposite the pressing direction.

2. The image transfer apparatus according to claim 1, wherein the retaining unit retains an outer diameter portion of the second rotating body.

3. The image transfer apparatus according to claim 1, further comprising an arm member having a rotation center, wherein at least a portion of the retaining unit is on the arm member.

4. The image transfer apparatus according to claim 1, wherein each of the first rotating body and the second rotating body includes a driving force transmitting unit configured to transmit a drive force from the same drive source or an individual drive source.

5. The image transfer apparatus according to claim 1, wherein the one way clutch mechanism includes teeth, the teeth having an associated pitch.

6. The image transfer apparatus according to claim 5, wherein the teeth have a pitch of no more than 200 μm.

7. An image fixing apparatus, comprising:

a first rotating body configured to rotate by a rotating drive force provided by a drive source, the first rotating body including a heating member or supporting the heating member, the first rotating body having a non-zero variation width;

a second rotating body opposite the first rotating body, the second rotating body configured to move freely in a pressing direction by a distance no less than the variation width of the first rotating body;

a pressing unit configured to press the second rotating body onto the first rotating body with a pressing force in order to fix a visible image on a transfer material that is transported through a nipping portion between the first rotating body and the second rotating body; and a retaining unit configured to maintain a distance between the first rotating body and the second rotating body while the thickness of the transfer material that passes through the nipping portion remains the same, wherein at least a portion of the retaining unit is movable in a horizontal direction and a vertical direction relative to the second rotating body, wherein the retaining unit includes a one-way clutch mechanism configured to regulate the movement of the second rotating body by the pressing unit in the pressing direction, the retaining unit configured to allow the second rotating body to move freely in a direction opposite the pressing direction.

8. The image fixing apparatus according to claim 7, wherein the retaining unit retains an outer diameter portion of the second rotating body.

9. The image fixing apparatus according to claim 7, further comprising an arm member having a rotation center, wherein at least a portion of the retaining unit is on the arm member.

10. The image fixing apparatus according to claim 7, wherein each of the first rotating body and the second rotating body includes a driving force transmitting unit configured to transmit a drive force from the same drive source or an individual drive source.

11. The image fixing apparatus of claim 7, wherein the one way clutch mechanism includes teeth, the teeth having an associated pitch.

12. The image fixing apparatus of claim 11, wherein the teeth have a pitch of no more than 200 μm.

13. A registration apparatus, comprising:

a first rotating body configured to rotate by a rotating drive force provided by a drive source, the first rotating body having a non-zero variation width;

a second rotating body opposite the first rotating body, the second rotating body configured to move freely in a pressing direction by a distance no less than the variation width of the first rotating body;

a pressing unit configured to press the second rotating body onto the first rotating body with a pressing force, wherein a sheet of a transfer material is transported into a nipping portion between the first rotating body and the second rotating body; and a retaining unit configured to maintain a distance between the first rotating body and the second rotating body as long as the thickness of the transfer material that passes through the nipping portion remains the same, wherein at least a portion of the retaining unit is movable in a horizontal direction and a vertical direction relative to the second rotating body, wherein the retaining unit includes a one-way clutch mechanism configured to regulate movement of the second rotating body by the pressing unit in the pressing direction, the retaining unit configured to allow the second rotating body to move freely in a direction opposite the pressing direction.

14. The registration apparatus according to claim 13, wherein the retaining unit retains an outer diameter portion of the second rotating body.

15. The registration apparatus according to claim 13, further comprising an arm member having a rotation center, wherein at least a portion of the retaining unit is on the arm member.

16. The registration apparatus according to claim 13, wherein each of the first rotating body and the second rotating body includes a driving force transmitting unit configured to transmit a drive force from the same drive source or an individual drive source.

17. The registration apparatus of claim 13, wherein the one way clutch mechanism includes teeth, the teeth having an associated pitch.

18. The registration apparatus of claim 17, wherein the teeth have a pitch of no more than 200 μm.

* * * * *